US009328685B2

(12) United States Patent
Suzuki et al.

(10) Patent No.: US 9,328,685 B2
(45) Date of Patent: May 3, 2016

(54) INTER-CYLINDER AIR-FUEL RATIO VARIATION ABNORMALITY DETECTION APPARATUS FOR MULTICYLINDER INTERNAL COMBUSTION ENGINE

(71) Applicants: Kenji Suzuki, Susono (JP); Hiroshi Miyamoto, Sunto (JP); Yasushi Iwazaki, Ebina (JP); Senji Kato, Susono (JP)

(72) Inventors: Kenji Suzuki, Susono (JP); Hiroshi Miyamoto, Sunto (JP); Yasushi Iwazaki, Ebina (JP); Senji Kato, Susono (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 246 days.

(21) Appl. No.: 14/212,400

(22) Filed: Mar. 14, 2014

(65) Prior Publication Data

US 2014/0283801 A1 Sep. 25, 2014

(30) Foreign Application Priority Data

Mar. 22, 2013 (JP) ..... 2013-060211

(51) Int. Cl.
*F02D 41/00* (2006.01)
*F02D 41/14* (2006.01)
*F02D 41/24* (2006.01)

(52) U.S. Cl.
CPC ..... *F02D 41/1495* (2013.01); *F02D 41/0085* (2013.01); *F02D 41/1441* (2013.01); *F02D 41/1456* (2013.01); *F02D 41/2438* (2013.01)

(58) Field of Classification Search
CPC F02D 41/008; F02D 41/0085; F02D 41/1495
USPC ..... 701/109; 123/673, 674; 73/114.72
See application file for complete search history.

(56) References Cited

U.S. PATENT DOCUMENTS 5,157,613 A * 10/1992 Williams ..... F02D 41/005 123/406.23
2011/0054761 A1 3/2011 Sawada et al.
2011/0179774 A1* 7/2011 Iihoshi ..... F02D 41/0085 60/276
2011/0192146 A1* 8/2011 Sugimoto ..... F02D 41/0085 60/276
2012/0022772 A1* 1/2012 Miyamoto ..... F02D 41/0037 701/104
2012/0174900 A1* 7/2012 Miyamoto ..... F02D 41/1495 123/703
2013/0184969 A1* 7/2013 Rollinger ..... F02D 41/22 701/103
2013/0197783 A1* 8/2013 Kato ..... F02D 41/1454 701/103
2013/0317723 A1* 11/2013 Deubler ..... F20D 41/0085 701/104

(Continued)

FOREIGN PATENT DOCUMENTS

JP H05-156988 A 6/1993
JP H11-315738 A 11/1999

(Continued)

*Primary Examiner* — Erick Solis
(74) *Attorney, Agent, or Firm* — Dinsmore & Shohl LLP

(57) ABSTRACT

A first parameter correlated with a degree of fluctuation of output from an air-fuel ratio sensor is calculated, and whether or not the calculated first parameter has a value between a predetermined primary determination upper-limit value α1H and a primary determination lower-limit value is determined. Such forced active control as reduces an air-fuel ratio shift in one of the cylinders which is subjected to a most significant air-fuel ratio shift is performed when the calculated first parameter is determined to have a value between the predetermined primary determination upper-limit value and the primary determination lower-limit value. A first parameter is calculated while the forced active control is in execution. The calculated first parameter is compared with a predetermined secondary determination value to determine whether or not variation abnormality is present.

8 Claims, 16 Drawing Sheets

(56) References Cited

U.S. PATENT DOCUMENTS

| | | | | |
|---|---|---|---|---|
| 2014/0156205 | A1* | 6/2014 | Suzuki | F02D 41/0085 702/24 |
| 2015/0075507 | A1* | 3/2015 | Iwase | F02D 41/0085 123/673 |

FOREIGN PATENT DOCUMENTS

| | | | |
|---|---|---|---|
| JP | 2009-030455 | A | 2/2009 |
| JP | 2011-047332 | A | 3/2011 |
| JP | 2011-247240 | A | 12/2011 |
| JP | 2012-197798 | A | 10/2012 |

* cited by examiner

BEFORE EXECUTION OF
FORCED ACTIVE CONTROL

| CYLINDER | #1 | #2 | #3 | #4 |
|---|---|---|---|---|
| AIR | 13 | 15 | 15 | 15 |
| FUEL | 1 | 1 | 1 | 1 |
| A/F | 13 | 15 | 15 | 15 |

IMBALANCE RATE
15 / 13 = 1.15 = 15%

FIG.11A

AFTER EXECUTION OF
FORCED ACTIVE CONTROL

| CYLINDER | #1 | #2 | #3 | #4 |
|---|---|---|---|---|
| AIR | 13 | 15 | 15 | 15 |
| FUEL | 0.91 | 1.03 | 1.03 | 1.03 |
| A/F | 14.28 | 14.56 | 14.56 | 14.56 |

IMBALANCE RATE
14.56 / 14.28 = 1.02 = 2%

FIG.11B

INTER-CYLINDER AIR-FUEL RATIO VARIATION ABNORMALITY DETECTION APPARATUS FOR MULTICYLINDER INTERNAL COMBUSTION ENGINE

CROSS-REFERENCES TO RELATED APPLICATIONS

This application claims the benefit of Japanese Patent Application No. 2013-060211, filed Mar. 22, 2013, which is hereby incorporated by reference herein in its entirety.

BACKGROUND OF THE INVENTION

1. Field of the Invention

The present invention relates to an apparatus for detecting variation abnormality in air-fuel ratio among cylinders of a multicylinder internal combustion engine, and in particular, to an apparatus that detects abnormality (imbalance abnormality) in which the air-fuel ratio of one cylinder deviates relatively significantly from the air-fuel ratio of the remaining cylinders.

2. Description of the Related Art

In general, an internal combustion engine with an exhaust purification system utilizing a catalyst efficiently removes harmful exhaust components using the catalyst and thus needs to control the mixing ratio between air and fuel in an air-fuel mixture combusted in the internal combustion engine, that is, the air-fuel ratio. To control the air-fuel ratio, an air-fuel ratio sensor is provided in an exhaust passage in the internal combustion engine to perform feedback control to make the detected air-fuel ratio equal to a predetermined air-fuel ratio.

On the other hand, a multicylinder internal combustion engine normally controls the air-fuel ratio using identical controlled variables for all cylinders. Thus, even when the air-fuel ratio control is performed, the actual air-fuel ratio may vary among the cylinders. In this case, if the variation is at a low level, the variation can be absorbed by the air-fuel ratio feedback control, and the catalyst also serves to remove harmful exhaust components. Consequently, such a low-level variation is prevented from affecting exhaust emissions and from posing an obvious problem.

However, if, for example, fuel injection systems for any cylinders become defective to significantly vary the air-fuel ratio among the cylinders, the exhaust emissions disadvantageously deteriorate. Such a significant variation in air-fuel ratio as deteriorates the exhaust emissions is desirably detected as abnormality. In particular, for automotive internal combustion engines, there has been a demand to detect variation abnormality in air-fuel ratio among the cylinders in a vehicle mounted state (on board) in order to prevent a vehicle with deteriorated exhaust emissions from travelling.

A possible method for detecting variation abnormality in air-fuel ratio among the cylinders involves calculating a parameter correlated with the degree of variation in output from the air-fuel ratio sensor and comparing the calculated parameter with a predetermined determination value to detect abnormality.

On the other hand, the output characteristics (gain, responsiveness, and the like) of an air-fuel ratio sensor actually installed in an internal combustion engine vary between tolerance upper-limit products and tolerance lower-limit products due to manufacturing variations and the like. Hence, the calculated value of the parameter corresponding to the same degree of variation in air-fuel ratio varies depending on the air-fuel ratio sensor.

On the other hand, a desired value for the degree of variation in air-fuel ratio which needs to be determined to be abnormal may be legally specified. In such a case, the determination value is specified in view of the desired value.

However, it has been found that not all air-fuel ratio sensors can meet the desired value because of the variation among the air-fuel ratio sensors. That is, it has been found that the tolerance upper-limit products allow abnormality to be detected when the parameter is smaller than the desired value, whereas the tolerance lower-limit products may fail to allow abnormality to be detected unless the parameter exceeds the desired value.

Thus, the present invention has been developed in view of the above-described circumstances. An object of the present invention is to provide an inter-cylinder air-fuel ratio variation abnormality detection apparatus that allows even an air-fuel ratio sensor corresponding to a tolerance lower-limit product to suitably and adequately detect variation abnormality.

SUMMARY OF THE INVENTION

An aspect of the present invention provides an inter-cylinder air-fuel ratio variation abnormality detection apparatus being configured to calculate a first parameter correlated with a degree of fluctuation of output from a first air-fuel ratio sensor installed in an exhaust passage common to a plurality of cylinders to detect inter-cylinder air-fuel ratio variation abnormality based on the calculated first parameter, the apparatus being configured to carry out:

(A) a step of calculating the first parameter;

(B) a step of determining whether or not the calculated first parameter has a value between a predetermined primary determination upper-limit value and a primary determination lower-limit value;

(C) a step of performing such forced active control as reduces an air-fuel ratio shift in one of the cylinders which is subjected to a most significant air-fuel ratio shift when the calculated first parameter is determined to have a value between the predetermined primary determination upper-limit value and the primary determination lower-limit value;

(D) a step of calculating the first parameter while the forced active control is in execution; and (E) a step of comparing the first parameter calculated while the forced active control is in execution with a predetermined secondary determination value to determine whether or not variation abnormality is present.

Preferably, the secondary determination value is pre-specified as a value of the first parameter corresponding to a predetermined upper-limit target value of a second parameter representing a degree of variation in air-fuel ratio among the cylinders, on a first characteristic line representing a relation between the first parameter and the second parameter observed when the first air-fuel ratio sensor is a tolerance lower-limit product and while the forced active control is in execution.

Preferably, the primary determination lower-limit value is pre-specified as a value of the first parameter corresponding to the upper-limit target value of the second parameter, on a second characteristic line representing a relation between the first parameter and the second parameter observed when the first air-fuel ratio sensor is a tolerance lower-limit product and while the forced active control is not in execution.

Preferably, the primary determination upper-limit value is pre-specified as a value of the first parameter corresponding to a predetermined lower-limit target value of the second parameter, on a third characteristic line representing a relation between the first parameter and the second parameter observed when the first air-fuel ratio sensor is a tolerance upper-limit product and while the forced active control is not in execution.

Preferably, the inter-cylinder air-fuel ratio variation abnormality detection apparatus is configured to further carry out (F) a step of comparing the first parameter with at least one of the primary determination upper-limit value and the primary determination lower-limit value to determine whether or not abnormality is present when, in the step (B), the first parameter is determined not to have a value between the primary determination upper-limit value and the primary determination lower-limit value.

Preferably, the inter-cylinder air-fuel ratio variation abnormality detection apparatus is configured to stop calculating the first parameter, while continuously performing the forced active control instead of stopping the forced active control when, while the step (D) is in execution, a predetermined prerequisite for execution of the step (D) fails to be achieved.

Preferably, the inter-cylinder air-fuel ratio variation abnormality detection apparatus is configured such that, when the prerequisite having not been achieved is re-achieved, the inter-cylinder air-fuel ratio variation abnormality detection apparatus starts calculating the first parameter at a point in time of the re-achievement.

Preferably, the inter-cylinder air-fuel ratio variation abnormality detection apparatus is configured to perform, while carrying out the step (D), air-fuel ratio main feedback control based on the output from the first air-fuel ratio sensor and air-fuel ratio sub feedback control based on output from a second air-fuel ratio sensor installed in the exhaust passage downstream of the first air-fuel ratio sensor with a catalyst located between the first and second air-fuel ratio sensors, and to correct a learning value for the air-fuel ratio sub feedback control by a value equivalent to a reduction in air-fuel ratio shift carried out by the forced active control.

The present invention exerts an excellent effect that allows even an air-fuel ratio sensor corresponding to a tolerance lower-limit product to suitably and adequately detect variation abnormality.

Further features of the present invention will become apparent from the following description of exemplary embodiments (with reference to the attached drawings).

BRIEF DESCRIPTION OF THE DRAWINGS

FIGS. 11A and 11B are tables for comparison of the imbalance rate obtained while forced active control is not in execution with the imbalance rate obtained while the forced active control is in execution, respectively;

DESCRIPTION OF THE EMBODIMENTS

An embodiment of the present invention will be described below with reference to the attached drawings.

Figure 1:
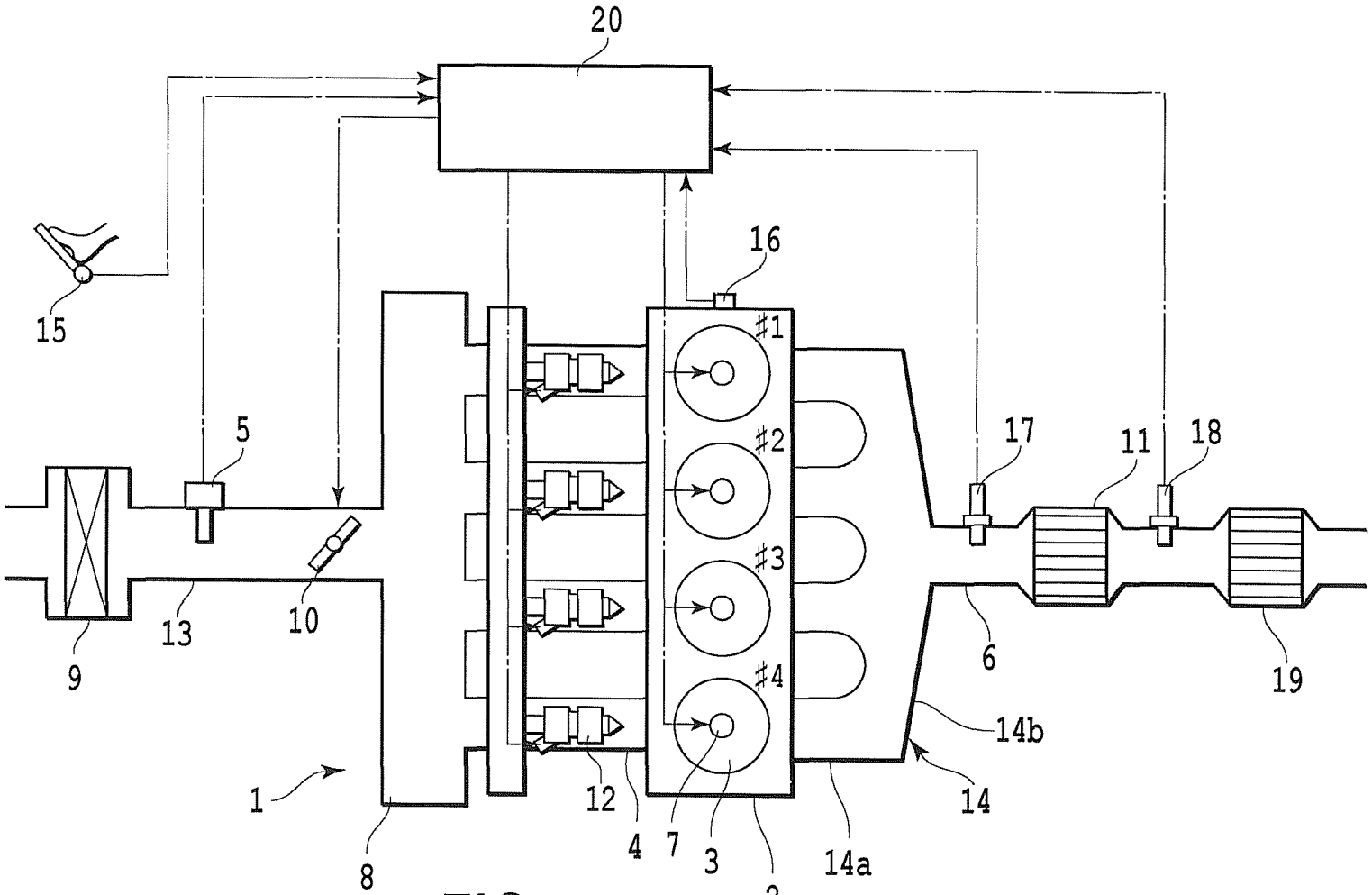
FIG. 1 is a schematic diagram of an internal combustion engine according to an embodiment of the present invention.

FIG. 1 is a schematic diagram of an internal combustion engine according to the present embodiment. An internal combustion engine (engine) 1 combusts a mixture of fuel and air inside a combustion chamber 3 formed in a cylinder block 2, and reciprocates a piston in the combustion chamber 3 to generate power. The internal combustion engine 1 according to the present embodiment is a multicylinder internal combustion engine mounted in a car, more specifically, an inline-four spark ignition internal combustion engine (gasoline engine). The internal combustion engine 1 includes a #1 cylinder to a #4 cylinder. However, the number, type, and the like of cylinders are not particularly limited.

Although not shown in the drawings, each cylinder includes an intake valve disposed therein to open and close an intake port and an exhaust valve disposed therein to open and close an exhaust port. Each intake valve and each exhaust valve are opened and closed by a cam shaft. Each cylinder includes an ignition plug 7 attached to a top portion of a cylinder head to ignite the air-fuel mixture in the combustion chamber 3.

The intake port of each cylinder is connected, via a branch pipe 4 for the cylinder, to a surge tank 8 that is an intake air aggregation chamber. An intake pipe 13 is connected to an upstream side of the surge tank 8, and an air cleaner 9 is provided at an upstream end of the intake pipe 13. The intake pipe 13 incorporates an air flow meter 5 (intake air amount detection device) for detecting the amount of intake air and an electronically controlled throttle valve 10, the air flow meter 5 and the throttle valve 10 being arranged in order from the upstream side. The intake port, the branch pipe 4, the surge tank 8, and the intake pipe 13 form an intake passage.

Each cylinder includes an injector (fuel injection valve) 12 disposed therein to inject fuel into the intake passage, particularly the intake port. The fuel injected by the injector 12 is mixed with intake air to form an air-fuel mixture, which is then sucked into the combustion chamber 3 when the intake valve is opened. The air-fuel mixture is compressed by the piston and then ignited and combusted by the ignition plug 7. The injector may inject fuel directly into the combustion chamber 3.

On the other hand, the exhaust port of each cylinder is connected to an exhaust manifold 14. The exhaust manifold 14 includes a branch pipe 14*a* for each cylinder which forms an upstream portion of the exhaust manifold 14 and an exhaust aggregation section 14*b* forming a downstream portion of the exhaust manifold 14. An exhaust pipe 6 is connected to the downstream side of the exhaust aggregation section 14*b*. The exhaust port, the exhaust manifold 14, and the exhaust pipe 6 form an exhaust passage.

Furthermore, the exhaust passage located downstream of the exhaust aggregation section 14*b* of the exhaust manifolds 14 forms an exhaust passage common to the #1 to #4 cylinders that are the plurality of cylinders.

Catalysts each including a three-way catalyst, that is, an upstream catalyst 11 and a downstream catalyst 19, are arranged in series and attached to an upstream side and a downstream side, respectively, of the exhaust pipe 6. The catalysts 11 and 19 have an oxygen storage capacity ($O_2$ storage capability). That is, the catalysts 11 and 19 store excess air in exhaust gas to reduce NOx when the air-fuel ratio of exhaust gas is higher (leaner) than a stoichiometric ratio (theoretical air-fuel ratio, for example, A/F=14.5). Furthermore, the catalysts 11 and 19 emit stored oxygen to oxidize HC and CO in the exhaust gas when the air-fuel ratio of exhaust gas is lower (richer) than the stoichiometric ratio.

A first air-fuel ratio sensor and a second air-fuel ratio sensor, that is, a pre-catalyst sensor 17 and a post-catalyst sensor 18, are installed upstream and downstream, respectively, of the upstream catalyst 11 to detect the air-fuel ratio of exhaust gas. The pre-catalyst sensor 17 and the post-catalyst sensor 18 are installed immediately before and after the upstream catalyst, respectively, to detect the air-fuel ratio based on the concentration of oxygen in the exhaust. The single pre-catalyst sensor 17 is thus installed in an exhaust junction section located upstream of the upstream catalyst 11. The pre-catalyst sensor 17 corresponds to a "first air-fuel ratio sensor" according to the present invention, and the post-catalyst sensor 18 is a "second air-fuel ratio sensor" according to the present invention.

The ignition plug 7, the throttle valve 10, the injector 12, and the like are electrically connected to an electronic control unit (hereinafter referred to as an ECU) 20 serving as a control device or a control unit. The ECU 20 includes a CPU, a ROM, a RAM, an I/O port, and a storage device, none of which is shown in the drawings. Furthermore, the ECU 20 connects electrically to, besides the above-described airflow meter 5, pre-catalyst sensor 17, and post-catalyst sensor 18, a crank angle sensor 16 that detects the crank angle of the internal combustion engine 1, an accelerator opening sensor 15 that detects the opening of an accelerator, and various other sensors via A/D converters or the like (not shown in the drawings). Based on detection values from the various sensors, the ECU 20 controls the ignition plug 7, the throttle valve 10, the injector 12, and the like to control an ignition period, the amount of injected fuel, a fuel injection period, a throttle opening, and the like in accordance with various program stored in the ROM so as to obtain desired outputs.

The throttle valve 10 includes a throttle opening sensor (not shown in the drawings), which transmits a signal to the ECU 20. The ECU 20 feedback-controls throttle opening to a target throttle opening dictated according to the accelerator opening.

Based on a signal from the air flow meter 5, the ECU 20 detects the amount of intake air, that is, an intake flow rate, which is the amount of air sucked per unit time. The ECU 20 detects a load on the engine 1 based on one of the detected throttle opening and amount of intake air.

Based on a crank pulse signal from the crank angle sensor 16, the ECU 20 detects the crank angle itself and the number of rotations of the engine 1. Here, the "number of rotations" refers to the number of rotations per unit time and is used synonymously with rotation speed. According to the present embodiment, the number of rotations refers to the number of rotations per minute rpm.

Figure 2:
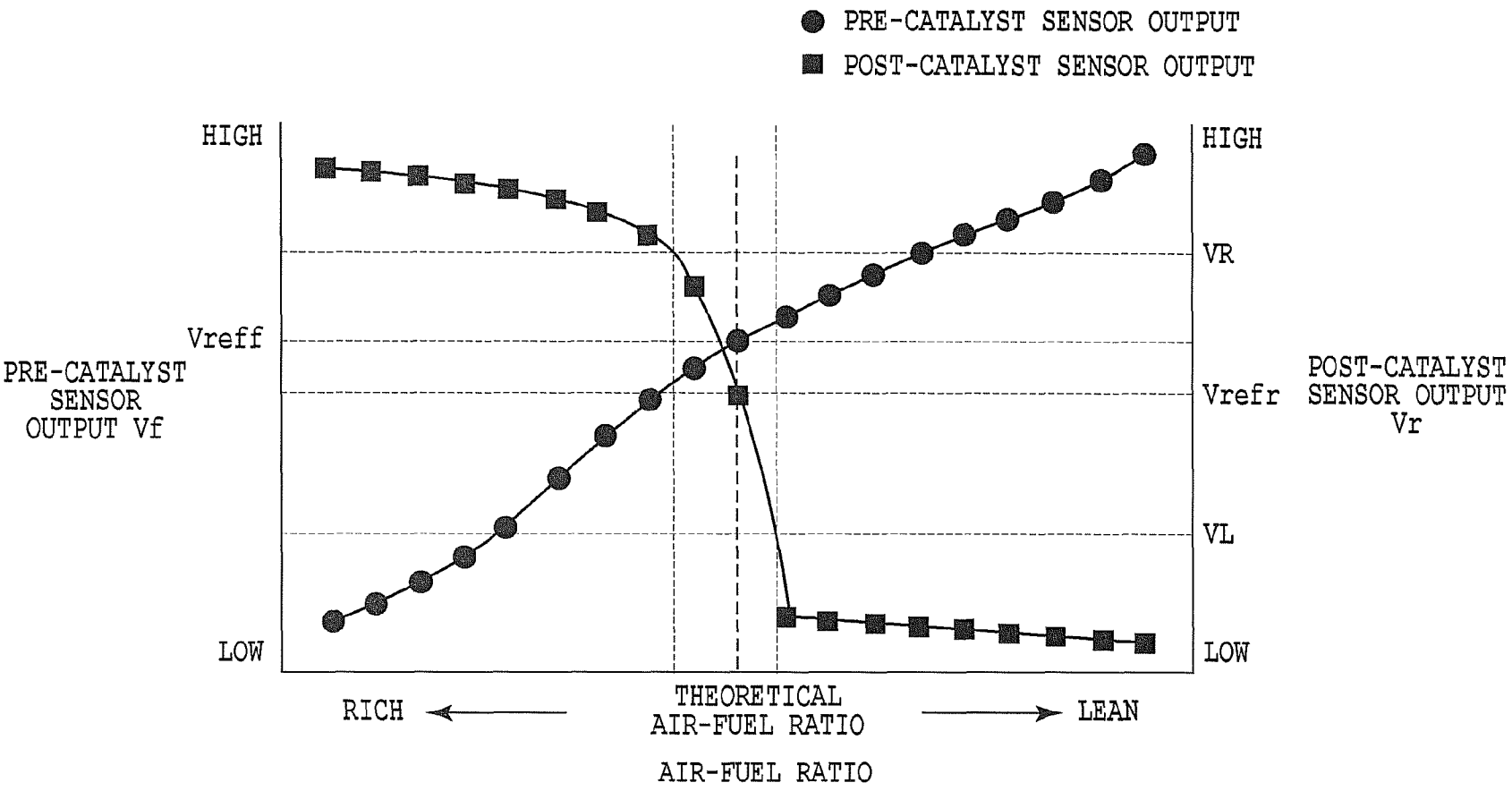
FIG. 2 is a graph showing the output characteristics of a pre-catalyst sensor and a post-catalyst sensor.

The pre-catalyst sensor 17 includes what is called a wide-range air-fuel ratio sensor and can consecutively detect a relatively wide range of air-fuel ratios. FIG. 2 shows output characteristic of the pre-catalyst sensor 17. As shown in FIG. 2, the pre-catalyst sensor 17 outputs a voltage signal Vf of a magnitude proportional to an exhaust air-fuel ratio. An output voltage obtained when the exhaust air-fuel ratio is stoichiometric is Vreff (for example, 3.3 V).

On the other hand, the post-catalyst sensor 18 includes what is called an $O_2$ sensor or an oxygen sensor and is characterized by an output value changing rapidly beyond the stoichiometric ratio. FIG. 2 shows the output characteristic of the post-catalyst sensor. As shown in FIG. 2, an output voltage obtained when the exhaust air-fuel ratio is stoichiometric, that is, a stoichiometrically equivalent value is Vrefr (for example, 0.45 V). The output voltage of the post-catalyst sensor 18 varies within a predetermined range (for example, from 0 V to 1 V). When the exhaust air-fuel ratio is leaner than the stoichiometric ratio, the output voltage of the post-catalyst sensor is lower than the stoichiometrically equivalent value Vrefr. When the exhaust air-fuel ratio is richer than the stoichiometric ratio, the output voltage of the post-catalyst sensor is higher than the stoichiometrically equivalent value Vrefr.

The upstream catalyst 11 and the downstream catalyst 19 simultaneously remove NOx, HC, and CO, which are harmful components in the exhaust, when the air-fuel ratio of exhaust gas flowing into each of the catalysts is close to the stoichiometric ratio. The range (window) of the air-fuel ratio within which the three components can be efficiently removed at the same time is relatively narrow.

Thus, during normal operation, the ECU 20 performs air-fuel ratio feedback control so as to control the air-fuel ratio of exhaust gas flowing into the upstream catalyst 11 to the neighborhood of the stoichiometric ratio. The air-fuel ratio feedback control includes air-fuel ratio main feedback control that controls the air-fuel ratio of an air-fuel mixture, specifically the amount of injected fuel, so as to make the exhaust air-fuel ratio detected by the pre-catalyst sensor 17 equal to the stoichiometric ratio, a predetermined target air-fuel ratio and air-fuel ratio sub feedback control that controls the air-fuel ratio of the air-fuel mixture, specifically the amount of injected fuel, so as to make the exhaust air-fuel ratio detected by the post-catalyst sensor 18 equal to the stoichiometric ratio.

The air-fuel ratio feedback control using the stoichiometric ratio as the target air-fuel ratio is referred to as stoichiometric control. The stoichiometric ratio corresponds to a reference air-fuel ratio.

For example, some of all the cylinders, particularly one cylinder, may fail to cause a variation (imbalance) in the air-fuel ratio among the cylinders. For example, the injector 12 for the #1 cylinder may fail, and a larger amount of fuel may be injected for the #1 cylinder than for the other cylinders, the #2, #3, and #4 cylinders. Thus, the air-fuel ratio in the #1 cylinder may be shifted significantly toward a rich side. Even in this case, the air-fuel ratio of total gas supplied to the pre-catalyst sensor 17 may be controlled to the stoichiometric ratio by performing the above-described stoichiometric control to apply a relatively large amount of correction. However, the air-fuel ratios of the individual cylinders are such that the air-fuel ratio of the #1 cylinder is much richer than the stoichiometric ratio, whereas and the air-fuel ratio of the #2, #3, and #4 cylinders is slightly leaner than the stoichiometric ratio. Thus, the air-fuel ratios are only totally in balance; only the total air-fuel ratio is stoichiometric. This is not preferable for emission control. Thus, the present embodiment includes an apparatus that detects such variation abnormality in air-fuel ratio among the cylinders.

An aspect of variation abnormality detection according to the present embodiment will be described below.

Figure 3:
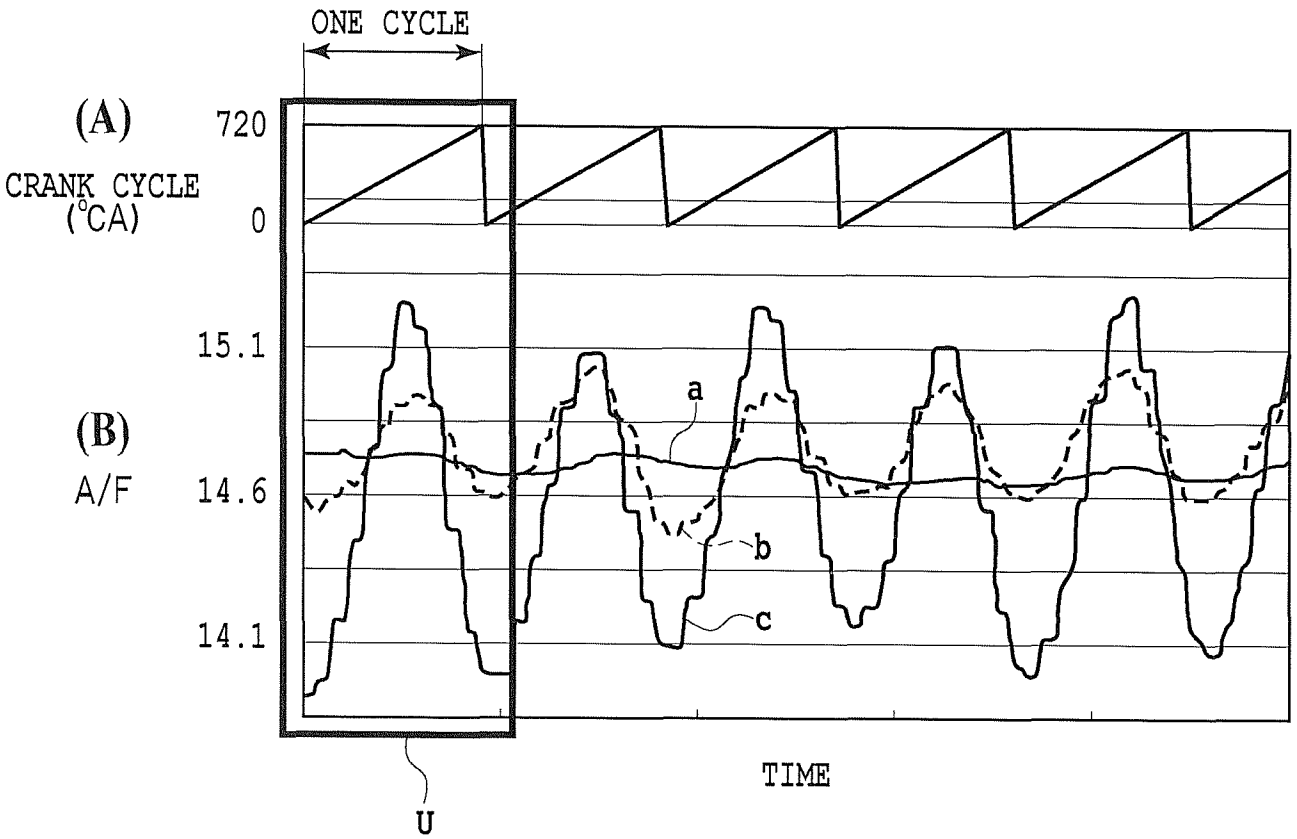
FIG. 3 is a graph showing a variation in exhaust air-fuel ratio depending on the degree of variation in air-fuel ratio among cylinders.

As schematically shown in FIG. 3, the exhaust air-fuel ratio varies periodically at every engine cycle (=720° CA), but varies significantly during each engine cycle when the air-fuel ratio varies among the cylinders. Air-fuel ratio lines a, b, c in (B) show air-fuel ratios detected by the pre-catalyst sensor 17 when no variation occurs in air-fuel ratio, when the air-fuel ratio shifts toward the rich side in only one cylinder at an imbalance rate of +20%, and when the air-fuel ratio shifts toward the rich side in only one cylinder at an imbalance rate of +50%, respectively. As seen in the air-fuel ratio lines, the amplitude of the variation in air-fuel ratio increases consistently with the degree of the variation among the cylinders.

In this case, the imbalance rate is a parameter (second parameter according to the present invention) representing the degree of the variation in air-fuel ratio among the cylinders. That is, the imbalance rate is a value representing the rate at which, if only one of all the cylinders is subjected to an air-fuel ratio shift with respect to the remaining cylinders, the cylinder subjected to the air-fuel ratio shift (imbalanced cylinder) deviates from the cylinders free from the air-fuel ratio shift (balanced cylinders). According to the present embodiment, the imbalance rate B is expressed by a formula below. An increase in imbalance rate B from 1 correspondingly increases the difference in air-fuel ratio between the imbalanced cylinder and the balanced cylinders and thus the degree of a variation in air-fuel ratio among the cylinders.

$$B = \frac{A/Fb}{A/Fib} \tag{1}$$

A/Fb denotes the air-fuel ratio of the balanced cylinder, and A/Fib denotes the air-fuel ratio of the imbalanced cylinder. For convenience, the imbalance rate may be shown in percentage. In this case, the imbalance rate B (%) is expressed by a formula below. An increase in the absolute value of the imbalance rate B (%) correspondingly increases the difference in air-fuel ratio between the imbalanced cylinder and the balanced cylinders and thus the degree of a variation in air-fuel ratio among the cylinders.

$$B(\%) = \left\{\frac{A/Fb}{A/Fib} - 1\right\} \times 100 \tag{1'}$$

As seen in FIG. 3, fluctuation of output from the pre-catalyst sensor 17 increases consistently with the absolute value of the imbalance rate B (%), that is, the degree of a variation in air-fuel ratio among the cylinders.

Thus, utilizing this characteristic, the present embodiment calculates or detects an output fluctuation parameter X that is a parameter (a first parameter according to the present invention) correlated with the degree of fluctuation of the output from the pre-catalyst sensor 17, and detects variation abnormality based on the calculated output fluctuation parameter X.

Figure 4:
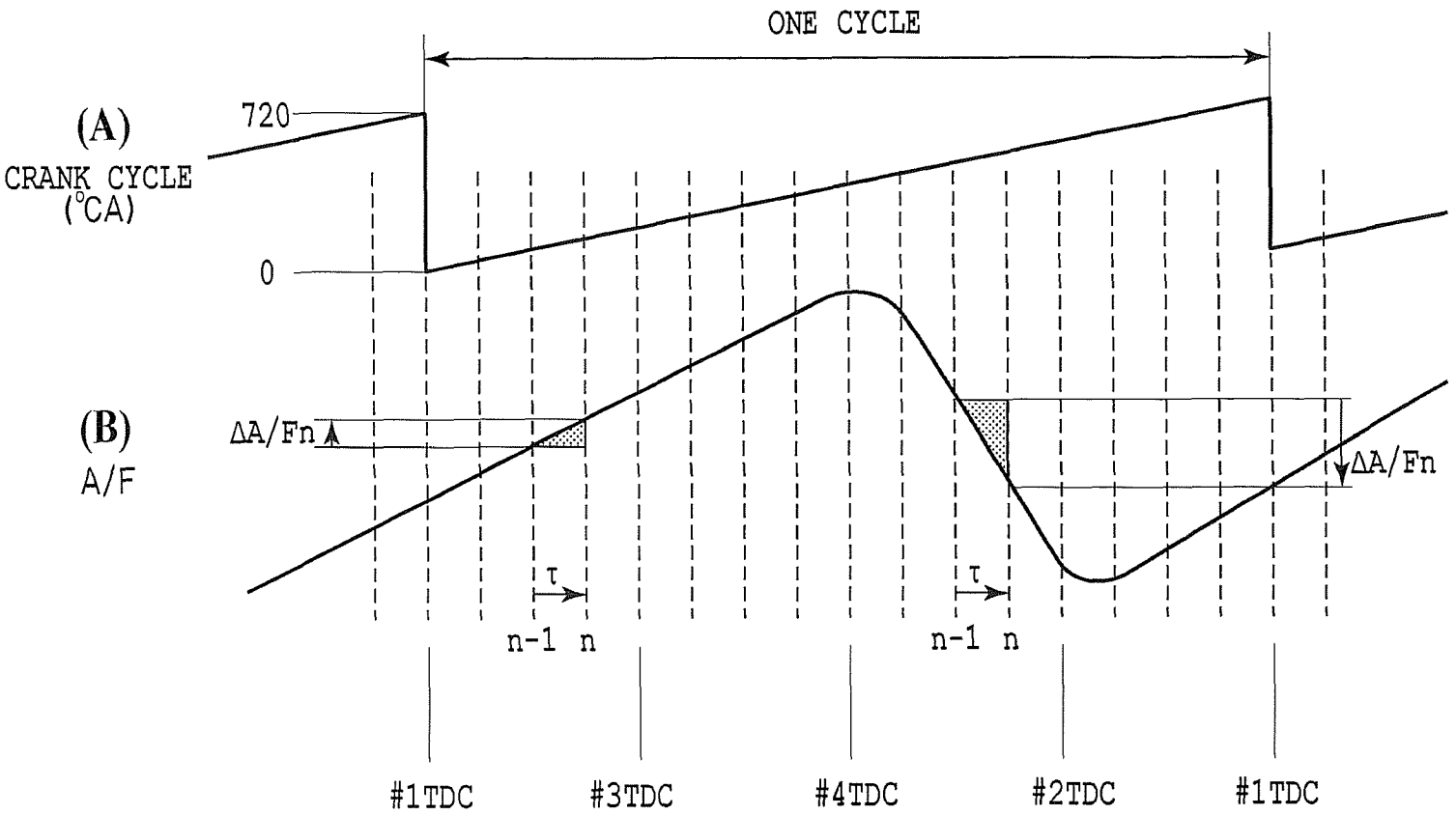
FIG. 4 is an enlarged value corresponding to a U portion of FIG. 3.

A method for calculating the output fluctuation parameter X will be described below. FIG. 4 is an enlarged view corresponding to a U portion in FIG. 3, specifically showing fluctuation of the pre-catalyst sensor output during one engine cycle. The pre-catalyst sensor output is an output voltage Vf from the pre-catalyst sensor 17 converted into the air-fuel ratio A/F. However, the output voltage Vf from the pre-catalyst sensor 17 may be directly used.

As shown in FIG. 4(B), during one engine cycle, the ECU 20 acquires the value of the pre-catalyst sensor output A/F at every predetermined sample period $\tau$. The ECU 20 then uses a formula below to determine the difference (also referred to as an output difference or a sensor output difference) between a value $A/F_n$ acquired at the current (n) timing and a value $A/F_{n-1}$ acquired at the preceding (n−1) timing. The output difference $\Delta A/F_n$ may also be translated as the differential value of the pre-catalyst sensor output at the current timing.

$$\Delta A/F_n = A/F_n - A/F_{n-1} \tag{2}$$

In the simplest aspect, the output difference $\Delta A/F_n$ itself represents the magnitude of fluctuation of the pre-catalyst sensor output. Thus, the output fluctuation parameter may be the absolute value of the output difference $\Delta A/F_n$ at one predetermined timing. However, according to the present embodiment, the output fluctuation parameter is the average value of a plurality of output differences $\Delta A/F_n$ for increased accuracy. The present embodiment calculates the output fluctuation parameter X by averaging the output differences $\Delta A/F_n$ for M engine cycles (for example, M=50). The output fluctuation parameter X increases consistently with the degree of fluctuation of the pre-catalyst sensor output.

However, the output difference $\Delta A/F_n$ may be positive or negative, and thus, the present embodiment distinguishes the positive output difference from the negative output difference for calculations. A method for calculation will be described below in detail. However, the calculation may be carried out without this distinction.

Any value corrected with the degree of fluctuation of the pre-catalyst sensor may be the output fluctuation parameter. For example, the output fluctuation parameter may be calculated based on the difference between the maximum peak and minimum peak (what is called, peak to peak) of the pre-catalyst sensor output during one engine cycle, or the absolute value of the maximum peak or minimum peak of a second order differential value. This is because an increase in the degree of fluctuation of the pre-catalyst sensor output correspondingly increases the difference between the maximum peak and minimum peak of the pre-catalyst sensor output or the absolute value of the maximum peak or minimum peak of a second order differential value.

The thus calculated output fluctuation parameter X is compared with a predetermined determination value $\alpha$ to determine whether or not variation abnormality is present. For example, variation abnormality is determined to be present when the calculated output fluctuation parameter X is equal to or larger than the determination value $\alpha$ (abnormal) and to be absent when the calculated output fluctuation parameter X is smaller than the determination value $\alpha$ (normal). As described below in detail, the determination value $\alpha$ is set in consideration for an OBD (On-Board Diagnosis) regulation value for exhaust emission.

As described above, the output characteristics (gain, responsiveness, and the like) of the pre-catalyst sensor 17, actually installed in the engine, vary between tolerance upper-limit products and tolerance lower-limit products due to a manufacturing variation and the like. Hence, the calculated value of the output fluctuation parameter X corresponding to the same degree of variation in air-fuel ratio, that is, the imbalance rate B, varies depending on the pre-catalyst sensor 17.

On the other hand, a desired value for the imbalance rate B that needs to be determined to be abnormal may be legally specified. In such a case, the determination value α is specified in view of the desired value.

However, it has been found that not all the pre-catalyst sensors 17 can meet the desired value because of the variation among the pre-catalyst sensors 17. That is, it has been found that the tolerance upper-limit products allow abnormality to be detected when the output fluctuation parameter X is less than the desired value, whereas some of the tolerance lower-limit products fail to allow abnormality to be detected unless the output fluctuation parameter X exceeds the desired value. This will be more specifically described.

Figure 5:
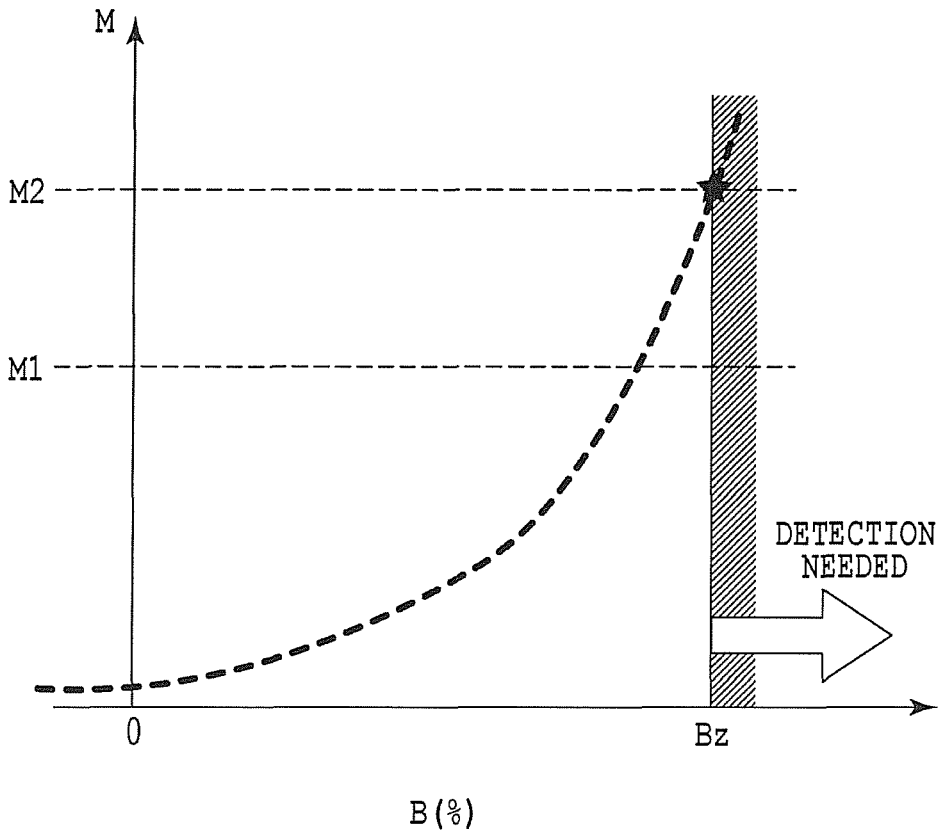
FIG. 5 is a graph illustrating a desired value for an imbalance rate.

FIG. 5 is a graph illustrating the desired value for the imbalance rate B. The axis of abscissas is indicative of the imbalance rate B(%). The axis of ordinate is indicative of the amount of emission of a particular emission component, in this case, NOx. M1 denotes an emission regulation value legally specified for the amount of NOx emission, and M2 denotes a legally specified OBD regulation value. The OBD regulation value M2 is specified to be, for example, 1.5 times as large as the emission regulation value.

As shown in FIG. 5, the amount of NOx emission M increases as the imbalance rate B(%) increases relative to 0, that is, as the amount of air-fuel ratio shift in one cylinder subjected to rich-side air-fuel ratio shift (rich-side imbalance). The imbalance rate Bz(%) corresponding to the OBD regulation value M2 is the desired value. This desired value is hereinafter referred to as a detection-needed imbalance rate.

When the actual imbalance rate B(%) is higher than the detection-needed imbalance rate Bz(%), abnormality inevitably needs to be detected. This is because, if abnormality fails to be detected, the amount of NOx emission M exceeds the OBD regulation value M2. In other words, the detection-needed imbalance rate Bz(%) means a lower limit value of the imbalance rate B that needs to be determined to be abnormal.

The value of the detection-needed imbalance rate Bz(%) varies depending on the type of the vehicle or the engine 1. However, the value falls within the range of 40% to 60%.

Figure 6:
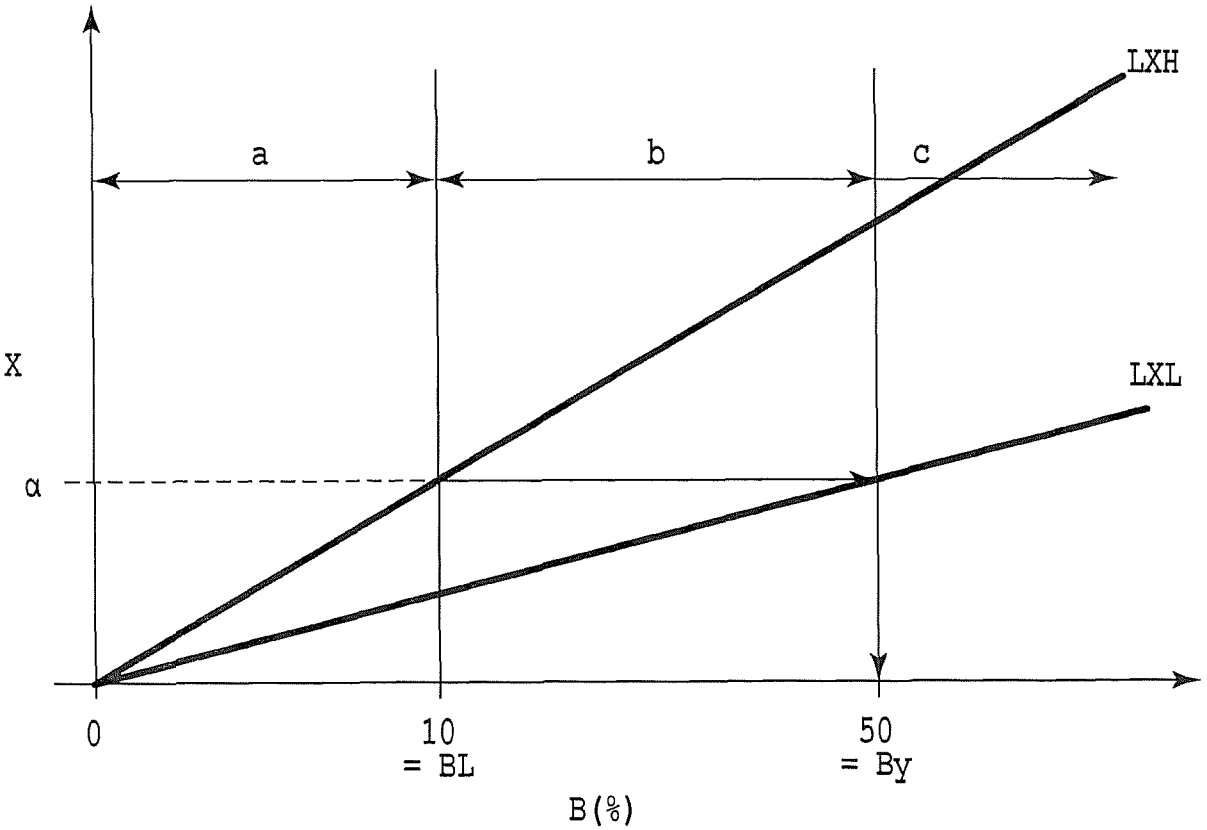
FIG. 6 is a graph showing characteristic lines obtained in a comparative example when the pre-catalyst sensor is a tolerance upper-limit product and when the pre-catalyst sensor is a tolerance lower-limit product.

FIG. 6 shows characteristics or characteristic lines representing the relation between the imbalance rate B(%) and the output fluctuation parameter X obtained when the pre-catalyst sensor 17 is a tolerance upper-limit product and when the pre-catalyst sensor 17 is a tolerance lower-limit product. In FIG. 6, LXH denotes a characteristic or a characteristic line obtained when the pre-catalyst sensor 17 is a tolerance upper-limit product, and LXL denotes a characteristic or a characteristic line obtained when the pre-catalyst sensor 17 is a tolerance lower-limit product. As is known, the tolerance upper-limit product refers to a product with the quickest response within the tolerance range. The tolerance lower-limit product refers to a product with the slowest response within the tolerance range. The present embodiment assumes that the pre-catalyst sensor 17, actually installed in the engine 1, is a normal sensor with responsiveness within the tolerance range.

As shown in FIG. 6, the imbalance rate B(%) and the output fluctuation parameter X have a first order proportional relation or characteristic. However, the relation changes depending on the output characteristics of the pre-catalyst sensor 17 (hereinafter simply referred to as the sensor output characteristics). For example, the characteristic line LXH of the tolerance upper-limit product has a larger inclination than the characteristic line LXL of the tolerance lower-limit product. The inclination of the characteristic line changes between LXH and LXL depending on the actually installed sensor.

Now, a setting or adapting the determination value a in a comparative example will be described. As shown in FIG. 6, first, the range (a) of the imbalance rate B(%) is determined which is inappropriate to determine to be abnormal (the range to be prevented from being determined to be abnormal) regardless of the sensor output characteristics. In the illustrated example, the range is 10% or less. The range (a) corresponds to the range of variation in imbalance rate B(%) in an assured normal state. An imbalance rate BL (=10(%)) defining the upper limit value of the range (a) is hereinafter referred to as a lower-limit target imbalance rate.

Then, on the characteristic line LXH of the tolerance upper-limit product, the value of the output fluctuation parameter X corresponding to the lower-limit target imbalance rate BL(%) is determined to be a determination value α. The value on the characteristic line LXH of the tolerance upper-limit product is used because the tolerance upper-limit product provides the maximum abnormality-side value of the output fluctuation parameter X.

On the other hand, on the characteristic line LXL of the tolerance lower-limit product, the imbalance rate corresponding to the determination value α is 50(%). That is, this abnormality detection apparatus fails to accurately detect abnormality unless the actual imbalance rate is higher than 50(%) regardless of the sensor output characteristics. In other words, the abnormality detection apparatus fails to accurately detect abnormality unless the actual imbalance rate B is higher than 50% when the actually installed pre-catalyst sensor 17 is a tolerance lower-limit product. When the pre-catalyst sensor 17 is a tolerance lower-limit product, abnormality can be accurately detected when the level of the imbalance rate is 50(%). Such a range that allows abnormality to be accurately detected is denoted by (c). Furthermore, on the characteristic line LXL of the tolerance lower-limit product, an imbalance rate By (=50(%)) corresponding to the determination value α is hereinafter referred to as a lower-limit product detectable imbalance rate.

Within a range (b) between the range (a) and the range (c), abnormality may be detected when the pre-catalyst sensor 17 is a tolerance upper-limit product.

Figure 7:
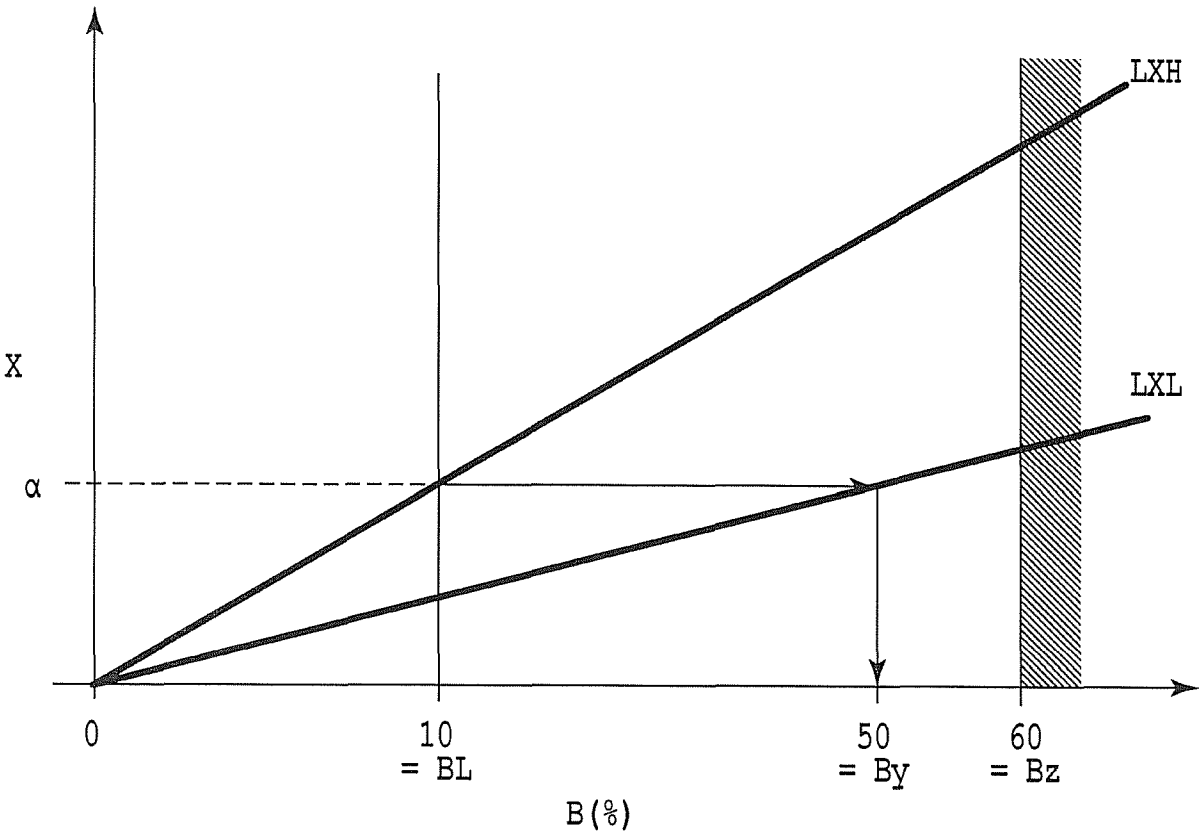
FIG. 7 is a graph showing a case where a detection-needed imbalance rate Bz is 60(%) in the comparative example.

FIG. 7 shows the comparative example shown in FIG. 6 in which the detection-needed imbalance rate Bz(%) is 60%. In this case, the detection-needed imbalance rate Bz(%) is higher than the lower-limit detectable imbalance rate By(%), the abnormality detection apparatus in the comparative example poses no problem. The system thus functions properly.

Figure 8:
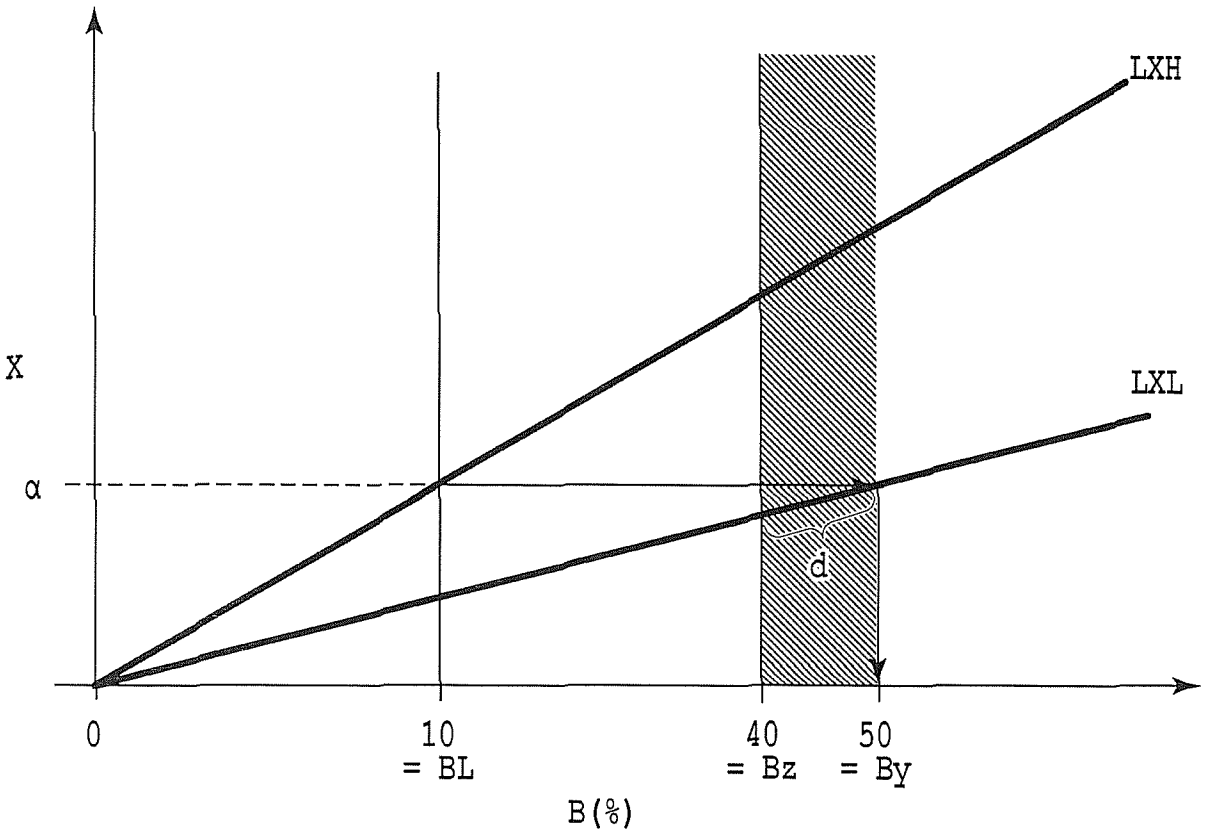
FIG. 8 is a graph showing a case where the detection-needed imbalance rate Bz is 40(%) in the comparative example.

FIG. 8 shows the comparative example shown in FIG. 6 in which the detection-needed imbalance rate Bz(%) is 40%. In this case, the detection-needed imbalance rate Bz(%) is lower than the lower-limit product detectable imbalance rate By(%), and thus, the apparatus may fail to accurately detect abnormality when the actually installed pre-catalyst sensor 17 is a tolerance lower-limit product. That is, despite the essential need to detect abnormality within a range (d) from Bz(%) to By(%), the apparatus mistakenly detects normality because the actual value of the output fluctuation parameter X fails to exceed the determination value α. Hence, the abnormality detection apparatus in the comparative example is problematic and the system fails to function properly.

Figure 9:
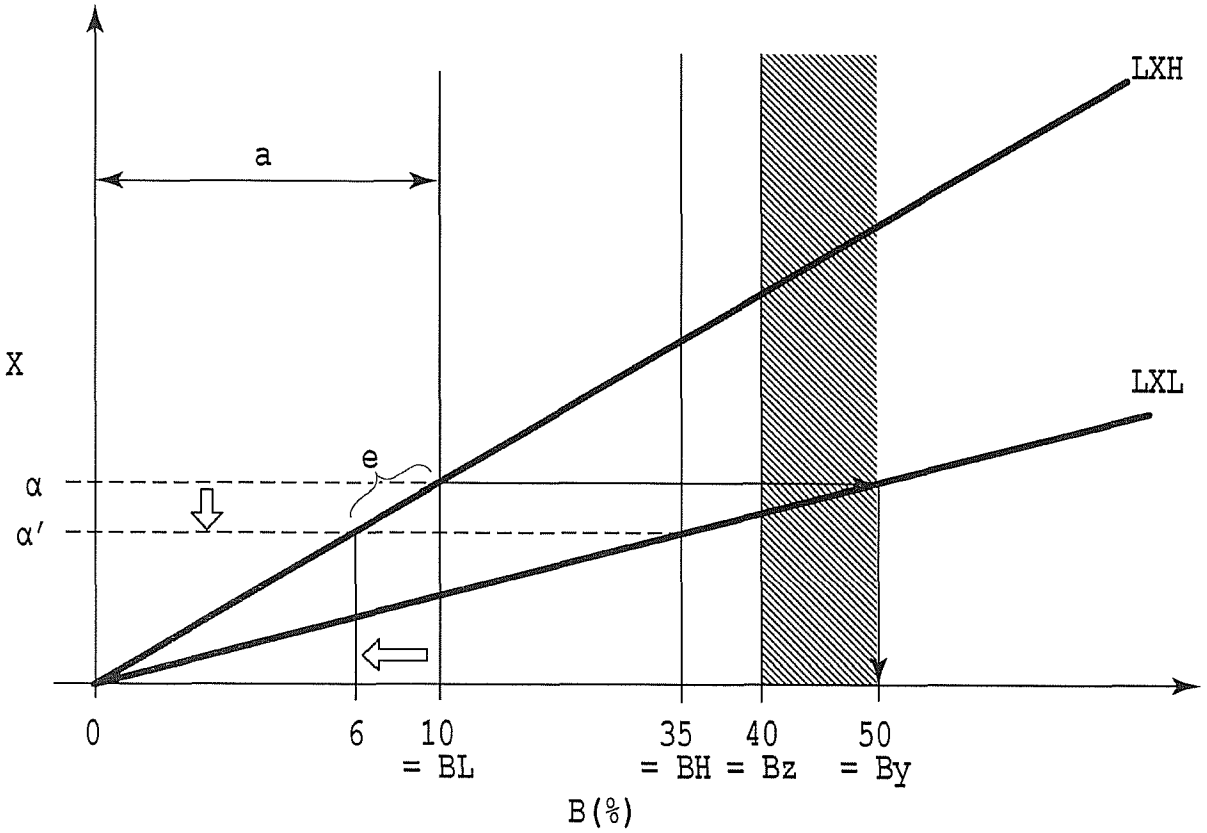
FIG. 9 is a graph illustrating a measure taken against the case in FIG. 8.

A possible measure against the case in FIG. 8 is as follows. That is, as shown in FIG. 9, first, an upper-limit target imbalance rate BH(%) is defined which is lower than the detection-needed imbalance rate Bz=40(%) by a predetermined margin. In the illustrated example, this rate is 35(%) and the margin is 5(%).

Then, on the characteristic line LXL of the tolerance upper-limit product, the value of the output fluctuation parameter X corresponding to the upper-limit target imbalance rate BH(%) is determined to be a determination value α'. That is, the determination value is changed to a smaller value α' based on the characteristic line LXL of the tolerance lower-limit product. This allows abnormality to be reliably detected before the actual imbalance rate reaches the detection-needed imbalance rate Bz(%) when the actually installed pre-catalyst sensor 17 is a tolerance lower-limit product. Furthermore, such a misdetection as described above can be prevented.

However, in this case, when the actually installed pre-catalyst sensor 17 is a tolerance upper-limit product, abnormality may be detected though the actual imbalance rate is lower than the lower-limit target imbalance rate BL (=10(%)). In the illustrated example, abnormality is detected within a range (e) from 6(%) to 10(%). That is, the lower-limit target imbalance rate BL substantially decreases. Then, abnormality is detected within the range (a) that is essentially inappropriate to determine to be abnormal. This is inconsistent with the above-described assumption.

As described above, even when an attempt is made to define a single determination value based only on the two characteristic lines, that is, the characteristic line LXH of the tolerance upper-limit product and the characteristic line LXL of the tolerance lower-limit product, the appropriate definition of the determination value is difficult when the detection-needed imbalance rate Bz(%) is lower than the lower-limit product detectable imbalance rate By(%).

Thus, the present embodiment additionally defines another determination value based on a characteristic line other than the above-described characteristic lines and detects abnormality based on the resultant determination values. This enables variation abnormality to be suitably and adequately detected regardless of the sensor output characteristics particularly even when the actually installed pre-catalyst sensor 17 is a tolerance lower-limit product.

A method for detecting variation abnormality according to the present embodiment will be described in detail. First, variation abnormality detection according to the present embodiment is performed by the ECU 20 by carrying out following steps (A) to (E).

(A) A step of calculating the output fluctuation parameter X.

(B) A step of determining whether or not the calculated output fluctuation parameter X has a value between a predetermined primary determination upper-limit value α1H and a primary determination lower-limit value α1L.

(C) A step of performing such forced active control as reduces an air-fuel ratio shift in one of the cylinders which is subjected to a most significant air-fuel ratio shift when the calculated output fluctuation parameter X is determined to have a value between the predetermined primary determination upper-limit value α1H and the primary determination lower-limit value α1L.

(D) A step of calculating the output fluctuation parameter X while the forced active control is in execution.

(E) A step of comparing the output fluctuation parameter X calculated while the forced active control is in execution with a predetermined secondary determination value α2 to determine whether or not variation abnormality is present.

Now, a method for setting the primary determination upper-limit value α1H, the primary determination lower-limit value α2L, and the secondary determination value α2 will be described with reference to FIG. 10. This setting is performed in an adaptation stage, and the set determination values are prestored in the ECU 20.

Figure 10:
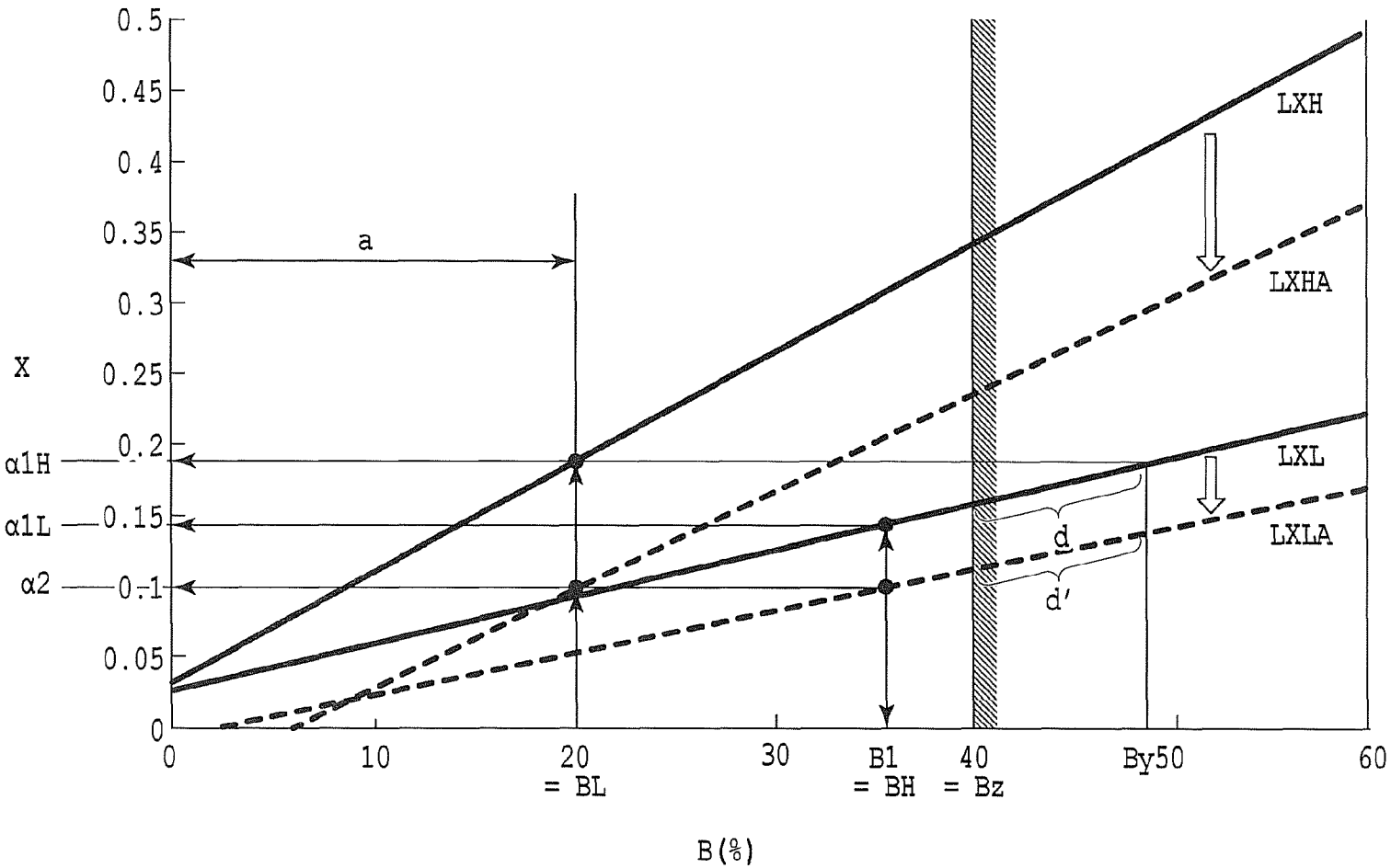
FIG. 10 is a graph illustrating a method for setting a primary determination upper-limit value, a primary determination lower-limit value, and a secondary determination value.

FIG. 10 shows characteristics or characteristic lines representing the relation between the imbalance rate B(%) and the output fluctuation parameter X. In particular, the imbalance rate B(%) on the axis of abscissas corresponds to the imbalance rate B(%) obtained in a normal control state, that is, while stoichiometric control as normal control is in execution, with forced active control not in execution. When the forced active control is in execution, the forced active control is performed while the stoichiometric control, serving as a base, is in execution.

As described above, LXH denotes a characteristic line obtained when the pre-catalyst sensor 17 is a tolerance upper-limit product, and LXL denotes a characteristic line obtained when the pre-catalyst sensor 17 is a tolerance lower-limit product. Both the characteristic lines are obtained while the forced active control is not in execution.

LXHA denotes a characteristic line obtained when the pre-catalyst sensor 17 is a tolerance upper-limit product and while the forced active control is in execution. Furthermore, LXLA denotes a characteristic line obtained when the pre-catalyst sensor 17 is a tolerance lower-limit product and while the forced active control is in execution. As described below in detail, the characteristic lines in the illustrated example are obtained when the forced active control is performed with a predetermined amount of forced active control Bf.

As seen in FIG. 10, when the forced active control is performed, the characteristic lines LXH and LXL shift toward a decrease side (smaller variation side) of the output fluctuation parameter X. Furthermore, the characteristic difference between the characteristic lines LXH and LXL decreases. This is because the forced active control is such control as reduces an air-fuel ratio shift in a cylinder subjected to the most significant air-fuel ratio shift.

(1) First, as described above, the range (a) of the imbalance rate B(%) is determined which is inappropriate to determine to be abnormal (the range to be prevented from being determined to be abnormal) regardless of the sensor output characteristics. In the illustrated example, the range is 20% or less. That is, the imbalance rate BL defining the upper limit value of the range (a) is 20(%).

(2) Then, on the characteristic line LXH of the tolerance upper-limit product, the value of the output fluctuation parameter X corresponding to the lower-limit target imbalance rate BL(%) is determined to be the primary determination upper-limit value α1H. In the illustrated example, α1H=about 0.19.

(3) Then, on the characteristic line LXHA obtained when the pre-catalyst sensor 17 is a tolerance upper-limit product and while the forced active control is in execution, the output fluctuation parameter X corresponding to the lower-limit target imbalance rate BL(%) is determined to be the secondary determination value α2. In the illustrated example, α2=about 0.1.

(4) Then, on the characteristic line LXLA obtained when the pre-catalyst sensor 17 is a tolerance lower-limit product and while the forced active control is in execution, the value of the imbalance rate B1(%) corresponding to the secondary determination value α2 is determined. Then, whether or not the value B1(%) is equal to or less than the detection-needed imbalance rate Bz(%) is checked. In the illustrated example, B1=about 35(%) and Bz=40(%), and thus, B1(%) is smaller than Bz(%). Hence, the B1(%) is determined to be the upper-limit target imbalance rate BH(%).

(5) Finally, on the characteristic line LXL for a tolerance lower-limit product, the output fluctuation parameter X corresponding to the upper-limit target imbalance rate BH(%) is determined to be the primary determination lower-limit value α1L. In the illustrated example, α1L=about 0.14.

In the illustrated example, the detection-needed imbalance rate Bz (=40%) is lower than the lower-limit product detectable imbalance rate By (=about 48%). Thus, when using only the primary determination upper-limit value α1H, the apparatus mistakenly detects normality within the range (d) when the tolerance lower-limit product is actually installed, as described above.

However, the present embodiment first determines whether or not the actually calculated output fluctuation parameter X has a value between the primary determination upper-limit value α1H and the primary determination lower-limit value α1L, that is, whether or not the parameter is in a gray zone in which the apparatus may mistakenly detect normality when the tolerance lower-limit product is actually installed. If the result of the determination is affirmative, the forced active control is performed, and the output fluctuation parameter X calculated while the forced active control is in execution is compared with the secondary determination value α2 to determine whether or not variation abnormality is present. That is, if the actually calculated output fluctuation parameter X is in the gray zone, the forced active control is performed to change the characteristic lines to the characteristic lines LXHA and LXLA, which form a smaller characteristic difference. Then, with the upper-limit target imbalance rate BH set lower than the detection-needed imbalance rate Bz(%), whether or not variation abnormality is determined.

As a result, the execution of the forced active control shifts the value in the range (d) to a value in a range (d'). The value in the range (d') is larger than the secondary determination value α2, allowing the determination of the presence of abnormality. This avoids misdetection to allow variation abnormality to be suitably and adequately detected even when the actually installed pre-catalyst sensor 17 is a tolerance lower-limit product.

Furthermore, the present embodiment allows the suitable and adequate detection, in the normal control state, of variation abnormality within the range of BH to Bz, which is lower than the range of Bz to By. This sufficiently meets the legal requirement that abnormality be inevitably detected when the actual imbalance rate B(%) exceeds the detection-needed imbalance rate Bz(%).

The reason why whether or not the B1(%) is equal to or lower than the detection-needed imbalance rate Bz(%) is as follows. The characteristic lines LXHA and LXLA, obtained while the forced active control is in execution, change depending on what amount of forced active control is performed, in other words, to what value the forced active control amount is set. Hence, in some cases, the B1(%) is higher than the detection-needed imbalance rate Bz(%). However, this precludes the system from functioning properly. Thus, the B1(%) is determined to be the upper-limit target imbalance rate BH(%) only when the B1(%) is equal to or lower than the upper-limit target imbalance rate BH(%). If, in contrast, the B1(%) is higher than the detection-needed imbalance rate Bz(%), an appropriate operation such as a change in the amount of forced active control is performed again.

In this case, the upper-limit target imbalance rate BH(%) is set to have a smaller value than the detection-needed imbalance rate Bz(%). However, the upper-limit target imbalance rate BH(%) is set to have a value equal to the value of the detection-needed imbalance rate Bz(%).

As is apparent from the above description, the characteristic line LXLA corresponds to a "first characteristic line" according to the present invention. The upper-limit target imbalance rate BH(%) corresponds to an "upper-limit target value of a second parameter". The characteristic line LXL corresponds to a "second characteristic line" according to the present invention. The characteristic line LXH corresponds to a "third characteristic line" according to the present invention. The lower-limit target imbalance rate BL(%) corresponds to a "lower-limit target value of the second parameter".

Now, the forced active control will be described. The forced active control is such control as reduces an air-fuel ratio shift in a cylinder subjected to the most significant air-fuel ratio shift, that is, what is called reverse active control.

FIGS. 11A and 11B are tables for comparison of the imbalance rates obtained while the forced active control is not in execution (before execution) and while the forced active control is in execution (after execution). Here, all the values of the amount of fuel and the air-fuel ratio shown in (A) and (B) are obtained after the air-fuel ratio of the total gas converges to the stoichiometric ratio (14.5) as a result of stoichiometric control.

FIG. 11A shows a state where imbalance is present in the normal control state and where the forced active control has not been performed yet. As is apparent from FIG. 11A, the amount of fuel is 1 in all the cylinders, but the amount of air varies due to the abnormality of a pneumatic system for the #1 cylinder; the amount of air is 13 only in the #1 cylinder and 15 in the other cylinders. Hence, the imbalance rate is 15/13=1.15=15%. A rich shift of the air-fuel ratio is occurring in the #1 cylinder.

This state may occur when, for example, a cylinder intake passage (branch pipe 4 or intake port) is blocked by deposits or the like or the intake valve is inappropriately opened.

FIG. 11B shows a state resulting from execution of the forced active control in the state in FIG. 11A. In this case, for a reduction in the rich shift in the #1 cylinder, the amount of fuel only in the #1 cylinder is forcibly decreased. As a result of such reduction and the stoichiometric control, the amount of fuel is 0.91 only in the #1 cylinder and 1.03 in the other cylinders. The air-fuel ratio is 14.28 only in the #1 cylinder and 14.56 in the other cylinders. Hence, the imbalance rate is 14.56/14.28=1.02=2%.

For the amount of fuel, the imbalance rate of the amount of fuel is 1.03/0.91=1.13=13%. In contrast, in the state where the forced active control has not been performed yet as shown in FIG. 11A, the imbalance rate of the amount of fuel is 1/1=1=0%. This means that the execution of the forced active control has forcibly reduced the amount of fuel in the #1 cylinder subjected to a rich shift, by 13%.

Thus, the imbalance rate of the amount of fuel=13% is referred to as the amount of reduction in air-fuel ratio shift carried out by the forced active control according to the present embodiment, that is, the amount of forced active control Bf. In other words, if a rich shift is occurring in a cylinder, the amount of fuel is forcibly reduced only in the cylinder by a value equivalent to the imbalance rate of the amount of fuel, 13%. The value of 13% is illustrative and can be appropriately changed.

The amount of forced active control Bf as described above is prestored in the ECU 20 as a constant value. Furthermore, the characteristic lines LXHA and LXLA, shown in FIG. 10 and obtained while the forced active control is in execution, result from the execution of the forced active control with the same amount of forced active control Bf.

The execution of the forced active control needs identification of one of all the cylinders which is subjected to the most significant air-fuel ratio shift, that is, a cylinder on which the forced active control is to be performed (the cylinder is hereinafter referred to as a forced active cylinder). Thus, the present embodiment carries out such identification in the following manner.

As shown in FIG. 4, during one engine cycle, ignition and combustion occur in the following order: the #1 cylinder, #3 cylinder, the #4 cylinder, and the #2 cylinder. The pre-catalyst sensor output A/F changes depending on the exhaust air-fuel ratio of each cylinder. In FIG. 4, TDC means a top dead center. In the illustrated example, rich shift imbalance is occurring As shown in FIG. 4, in the normal control state, a rich shift imbalance is occurring in the #4 cylinder. As shown in FIG. 4, when the pre-catalyst sensor 17 receives exhaust gas in the #4 cylinder, the pre-catalyst sensor output A/F decreases relatively rapidly toward the rich side. Otherwise the pre-catalyst sensor output A/F decreases relatively slowly toward the rich side.

Thus, the present embodiment associates the pre-catalyst sensor output A/F and the output difference $\Delta A/F_n$ with each cylinder, calculates the average of the output difference $\Delta A/F_n$ for each cylinder, and identifies a cylinder with the largest average value on a plus side as a forced active cylinder.

Alternatively or additionally, a cylinder with the most significant lean shift imbalance may be determined to be a forced active cylinder, and forced active control may be performed on the forced active cylinder so as to forcibly increase the amount of fuel injected for the forced active cylinder. In this case, a cylinder with the largest average value of the output difference $\Delta A/F_n$ on the positive side is determined to be a forced active cylinder.

Another method including a well-known method can be used to identify the forced active cylinder. For example, as shown in FIG. 4, the forced active cylinder may be identified based on the relation between the crank angle and the maximum peak and minimum peak of the pre-catalyst sensor output A/F.

A specific process of detecting variation abnormality according to the present embodiment will be described.

Figure 12:
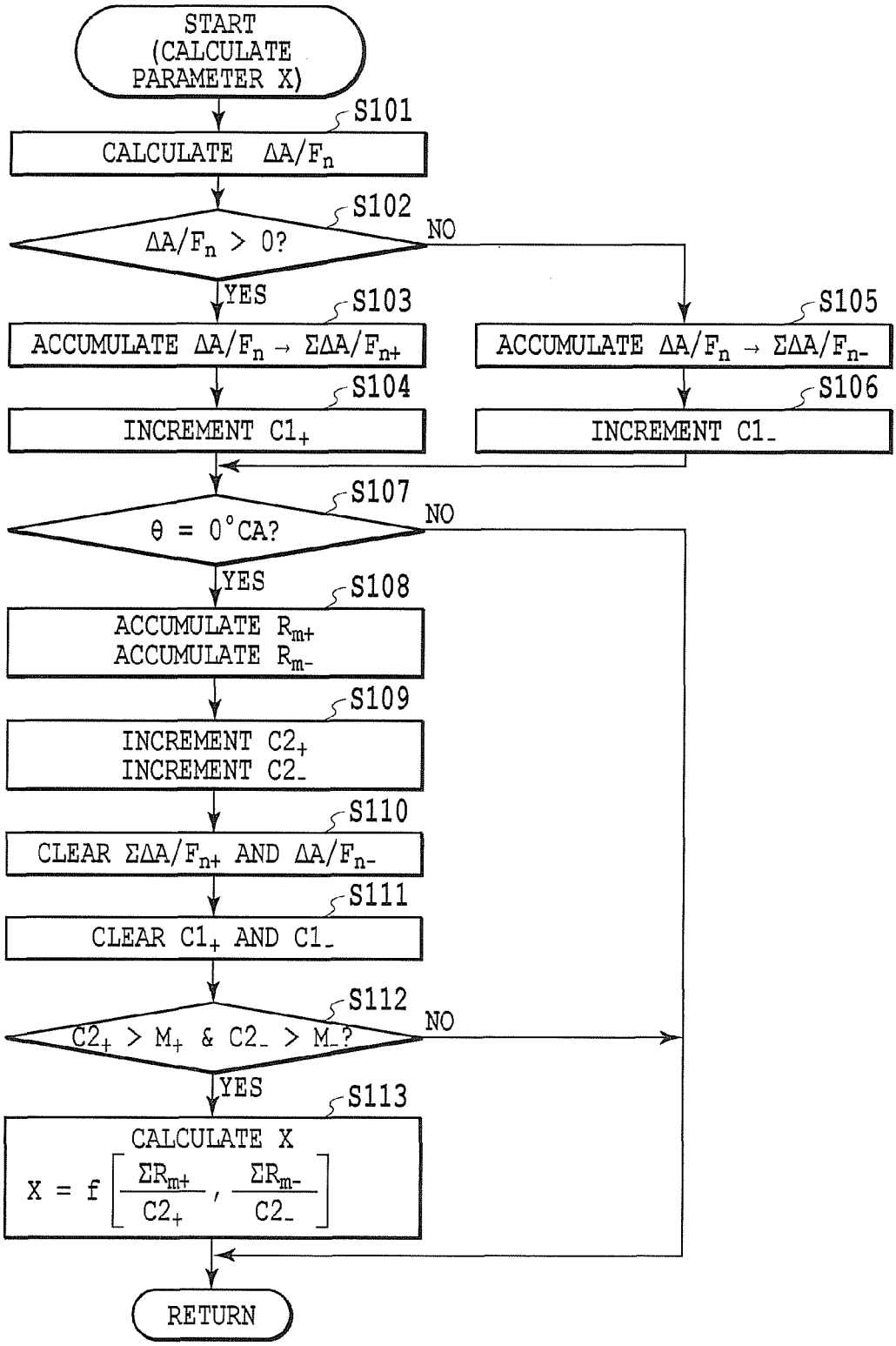
FIG. 12 is a flowchart of a process of calculating an output fluctuation parameter.

First, a process of calculating the output fluctuation parameter X which is a basic process according to the present embodiment will be described. This calculation process is carried out by the ECU 20 by repeatedly executing such a routine as shown in FIG. 12 at every calculation period.

First, in step S101, a pre-catalyst sensor output $A/F_n$ at the current sample time or timing n is acquired. A sensor output difference $\Delta A/F_n$ at the current timing is calculated in accordance with Formula (2). Now, both values of the pre-catalyst sensor output $A/F_n$ and the sensor output difference $\Delta A/F_n$ are associated with the number of the cylinder which forms a source of exhaust gas causing the both values. Both values and the cylinder number are stored in the ECU in sets. This is to allow the forcibly imbalanced cylinder to be subsequently identified.

Then, in step S102, whether the sensor output difference $\Delta A/F_n$ obtained at the current timing is greater than zero is determined.

If the sensor output difference $\Delta A/F_n$ is greater than zero, that is, the sensor output difference (inclination) $\Delta A/F_n$ obtained at the current timing is positive and has a value obtained during an increase in pre-catalyst sensor output, step S103 accumulates, for integration, the positive sensor output characteristic $\Delta A/F_n$ obtained at the current timing. The integrated value $\Sigma\Delta A/F_{n+}$ is calculated by:

$$\Sigma\Delta A/F_{n+}=\Sigma\Delta A/F_{(n-1)+}+\Delta A/F_n \quad (3)$$

Then, in step S104, the number of integrations $C1_+$ of the positive sensor output difference (inclination) $\Delta A/F_n$ is incremented by 1. On the other hand, in step S102, if the sensor output difference $\Delta A/F_n$ is equal to or smaller than zero, that is, the sensor output difference (inclination) $\Delta A/F_n$ obtained at the current timing is zero or negative and has a value obtained while the pre-catalyst sensor output remains unchanged or is decreasing, step S105 accumulates, for integration, the negative sensor output characteristic $\Delta A/F_n$ obtained at the current timing. The integrated value $\Sigma\Delta A/F_{n-}$ is calculated by:

$$\Sigma\Delta A/F_{n-}=\Sigma\Delta A/F_{(n-1)-}+\Delta A/F_n \quad (4)$$

Then, in step S106, the number of integrations C1_ of the negative sensor output difference (inclination) $\Delta A/F_n$ is increased (incremented) by 1.

Then, step S107 determines whether or not a crank angle θ obtained at the current timing is 0° CA that is a reference crank angle during each engine cycle (0° CA to 720° CA). The reference crank angle defines a timing for calculating the average value of the sensor output difference $\Delta A/F_n$ during each engine cycle. The reference crank angle can be set to a value other than 0° CA. According to the present embodiment, 0° CA, which is the reference crank angle, is equal to the compression top dead center of the #1 cylinder (see FIG. 4).

When the crank angle θ is not 0° CA, the routine is terminated. On the other hand, when the crank angle θ is 0° CA, step S108 calculates the average value of the sensor output difference $\Delta A/F_n$ at the end of the current engine cycle and accumulates the average value for integration. First, for a positive sensor output difference $\Delta A/F_n$, the integrated value $\Sigma\Delta A/F_{n+}$ of the positive sensor output difference is divided by the number of integrations $C1_+$ to calculate an average value for each engine cycle $R_{m+}$ $(=\Sigma\Delta A/F_{n+})/C1_+)$. The average value $R_{m+}$ is added to the integrated value of the average value for each engine cycle to determine the integrated value $\Sigma R_{m+}$ of the average value $R_{m+}$. The integrated value $\Sigma R_{m+}$ is calculated by:

$$\Sigma R_{m+}=\Sigma R_{(m-1)+}+R_{m+} \quad (5)$$

Similarly, for a negative sensor output difference $\Delta A/F_n$, the integrated value $\Sigma\Delta A/F_{n-}$ of the negative sensor output difference is divided by the number of integrations C1_ to calculate an average value for each engine cycle $R_{m-}$ $(=\Sigma\Delta A/F_{n-})/C1_-)$. The average value $R_{m-}$ is added to the integrated value of the average value for each engine cycle to determine the integrated value $\Sigma R_{m-}$ of the average value $R_{m-}$. The integrated value $\Sigma R_{m-}$ is calculated by:

$$\Sigma R_{m-}=\Sigma R_{(m-1)-}+R_{m-} \quad (6)$$

Then, in step S109, the values of the numbers of integrations $C2_+$ and C2_ of the positive average value $R_{m+}$ and the negative average value $R_{m-}$ for each engine cycle are increased (incremented) by 1.

Subsequently, in step S110, the integrated value $\Sigma\Delta A/F_{n+}$ of the positive sensor output difference and the integrated value $\Sigma\Delta A/F_{n-}$ of the negative sensor output difference are cleared to zero. Then, in step S111, the values of the number of integrations $C1_+$ of the positive sensor output difference and the number of integrations C1_ of the negative sensor output difference are cleared to zero.

Then, step S112 determines whether or not the number of integrations $C2_+$ of the positive average value for each engine cycle has reached a threshold $M_+$ or more and the number of integrations C2_ of the negative average value for each engine cycle has reached a threshold M_. According to the present embodiment, for example, $M_+=M_-=50$. If the result of the determination is negative, the routine is terminated.

On the other hand, if the result of the determination is affirmative, step S113 calculates the average value $(\Sigma R_{m+})/C2_+$ for engine cycles equal to the integrated value $\Sigma R_{m+}$ divided by the number of integrations $C2_+$ and the average value $(\Sigma R_{m-})/C2_-$ for M_ engine cycles equal to the integrated value $\Sigma R_{m-}$ divided by the number of integrations $C2_-$. The output fluctuation parameter X is then calculated based on both average values.

According to the present embodiment, the average value of the absolute value of both average values is calculated to be the output fluctuation parameter X. However, any other value may be used. For example, the larger of the absolute values of both average values or the sum of the absolute values of both average values may be calculated to be the output fluctuation parameter X. When the output fluctuation parameter X is calculated, the routine is terminated.

Figure 13:
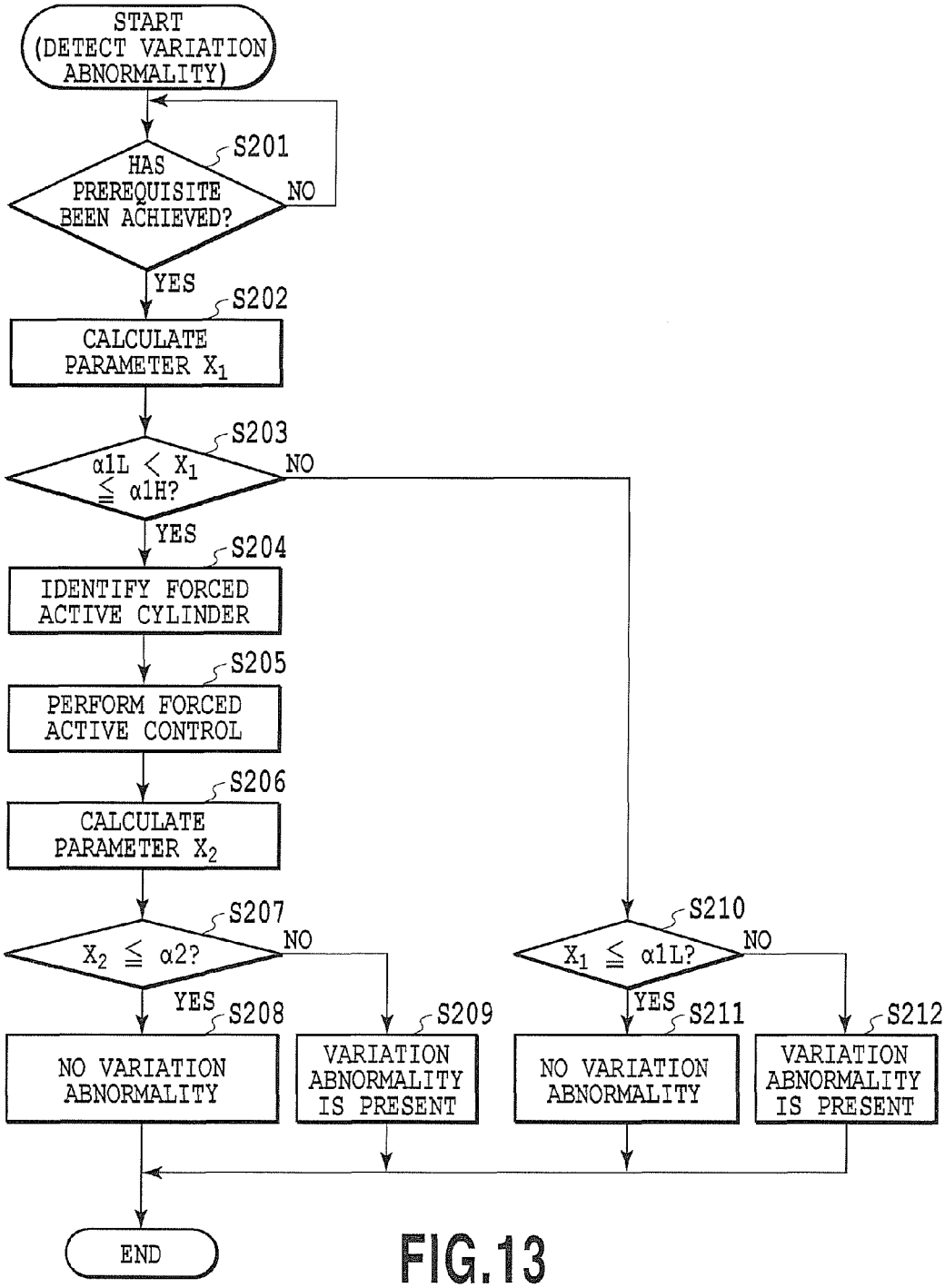
FIG. 13 is a flowchart of a process of detecting abnormality variation.

Now, a process of detecting variation abnormality will be described. The detection process is carried out by the ECU 20 in accordance with such an algorithm as illustrated in a flowchart in FIG. 13.

First, in step S201 determines whether or not a predetermined prerequisite suitable for execution of the variation abnormality detection has been achieved. For example, the prerequisite is achieved when the following conditions are met.

(1) Warm-up of the engine has ended.

(2) The pre-catalyst sensor 17 and the post-catalyst sensor 18 have been activated.

(3) The upstream catalyst 11 and the downstream catalyst 19 have been activated.

(4) The number of rotations Ne of the engine and a load KL fall within predetermined ranges. For example, the number of rotations falls within the range of 0 (rpm) to 2,000 (rpm), and the load KL falls within the range from 40(%) to 60(%).

(5) Stoichiometric control is being performed.

Another example of the prerequisite is possible. For example, the following condition may be added: (6) the engine is in steady operation.

If the prerequisite has not been achieved, the process waits. If the prerequisite is achieved, the process proceeds to step S202. In this case, steps subsequent to step S202 are carried out only if the prerequisite has been achieved.

In step S202, the value of an output fluctuation parameter $X_1$ obtained in the normal control state in which the forced active control is not in execution is calculated. The calculation is carried out by executing a routine illustrated in FIG. 12.

Step S203 determines whether or not the calculated output fluctuation parameter X1 has a value between the primary determination upper-limit value $\alpha 1H$ and the primary determination lower-limit value $\alpha 1L$, that is, whether or not $\alpha 1H<X_1\leq\alpha 1H$. Such a determination is hereinafter referred to as a primary determination.

If $\alpha 1H<X_1\leq\alpha 1H$, one of the cylinders is expected to be subjected to such an air-fuel ratio shift as occurs in the above-described gray zone. Thus, in this case, the forced active cylinder is identified in step S204. At this time, the set data on the sensor output difference $\Delta A/F_n$ and the cylinder numbers are utilized, which has been acquired in step S101 of the routine in FIG. 12.

For example, the average value (whether positive or negative) of the sensor output difference $\Delta A/F_n$ for each cylinder number is determined. Then, a cylinder with the largest absolute value of the average number is determined to be a forced active cylinder. As seen in FIG. 4, in the absolute value of the average value of the sensor output difference $\Delta A/F_n$, the #4 cylinder, in which rich shift imbalance is occurring in the normal control state, is greater than the other cylinders. Thus, this method enables the forced active cylinder to be identified.

In this case, the process also determines whether the forced active cylinder is subjected to rich shift imbalance or lean shift imbalance in the normal control state. At this time, if the average value of the sensor output difference $\Delta A/F_n$ for the forced active cylinder is positive, the forced active cylinder is determined to be subjected to lean shift imbalance. If the average value of the sensor output difference $\Delta A/F_n$ for the forced active cylinder is negative, the forced active cylinder is determined to be subjected to rich shift imbalance.

Then, in step S205, the forced active control is performed. That is, the amount of fuel injected for the forced active cylinder is reduced or increased to decrease the air-fuel ratio shift in the forced active cylinder. At this time, if step 204 determines that the forced active cylinder is subjected to rich shift imbalance, the amount of injected fuel is reduced to decrease the rich shift. In contrast, if step 204 determines that the forced active cylinder is subjected to lean shift imbalance, the amount of injected fuel is increased to decrease the lean shift.

In step S206, the value of an output fluctuation parameter $X_2$ obtained while the forced active control is in execution is calculated. Again, the calculation is carried out by executing the routine shown in FIG. 12.

In step S207, the value of the calculated output fluctuation parameter $X_2$ is compared with the secondary determination value $\alpha_2$ to determine whether the calculated output fluctuation parameter $X_2$ is larger or smaller than the secondary determination value $\alpha_2$. Such a determination is hereinafter referred to as a secondary determination.

If the value of the output fluctuation parameter $X_2$ is equal to or smaller than the secondary determination value $\alpha 2$, step 208 determines that no variation abnormality is present, that is, the engine is normal.

On the other hand, if the value of the output fluctuation parameter $X_2$ is larger than the secondary determination value $\alpha 2$, step 209 determines that variation abnormality is present, that is, the engine is abnormal. In this case, a warning device such as a check lamp is activated to inform the user of the abnormality. The user is thus urged to repair the cylinder.

In step S203, if the value of the output fluctuation parameter X1 in the normal control state falls out of the range $\alpha 1<X_1\leq\alpha 1H$, the cylinder is expected be in a definitely normal or abnormal state. Thus, in this case, step S210 compares the value of the output fluctuation parameter $X_1$ with the primary determination lower-limit value $\alpha 1L$ to directly determine whether the engine is normal or abnormal.

That is, if the value of the output fluctuation parameter $X_1$ is equal to or smaller than the primary determination lower-limit value $\alpha 1L$, step S211 determines that no variation abnormality is present, that is, the engine is normal.

If the value of the output fluctuation parameter $X_1$ is larger than the primary determination lower-limit value $\alpha 1L$, this means that the value of the output fluctuation parameter $X_1$ is larger than the primary determination upper-limit value $\alpha 1H$. Thus, step S212 determines that variation abnormality is present, that is, the cylinder is abnormal.

Besides the comparison only with the primary determination lower-limit value $\alpha 1L$ as described above, the following methods are possible for directly determining normality or abnormality: a comparison only with the primary determination upper-limit value $\alpha 1H$, a comparison both with the primary determination lower-limit value $\alpha 1L$ and with the primary determination upper-limit value $\alpha 1H$, and the like.

Thus, according to the present embodiment, the ECU 20 also carries out step (F).

(F) a step of comparing the output fluctuation parameter X1 with at least one of the primary determination upper-limit value α1H and the primary determination lower-limit value α1L to determine whether or not variation abnormality is present when step (B) determines that the output fluctuation parameter X fails to have a value between the primary determination upper-limit value α1H and the primary determination lower-limit value α1L.

Variations of the present embodiment will be described.

First, a first variation will be described. In the above-described basic embodiment, the steps subsequent to step S202 are carried out only when the prerequisite has been achieved.

Figure 14:
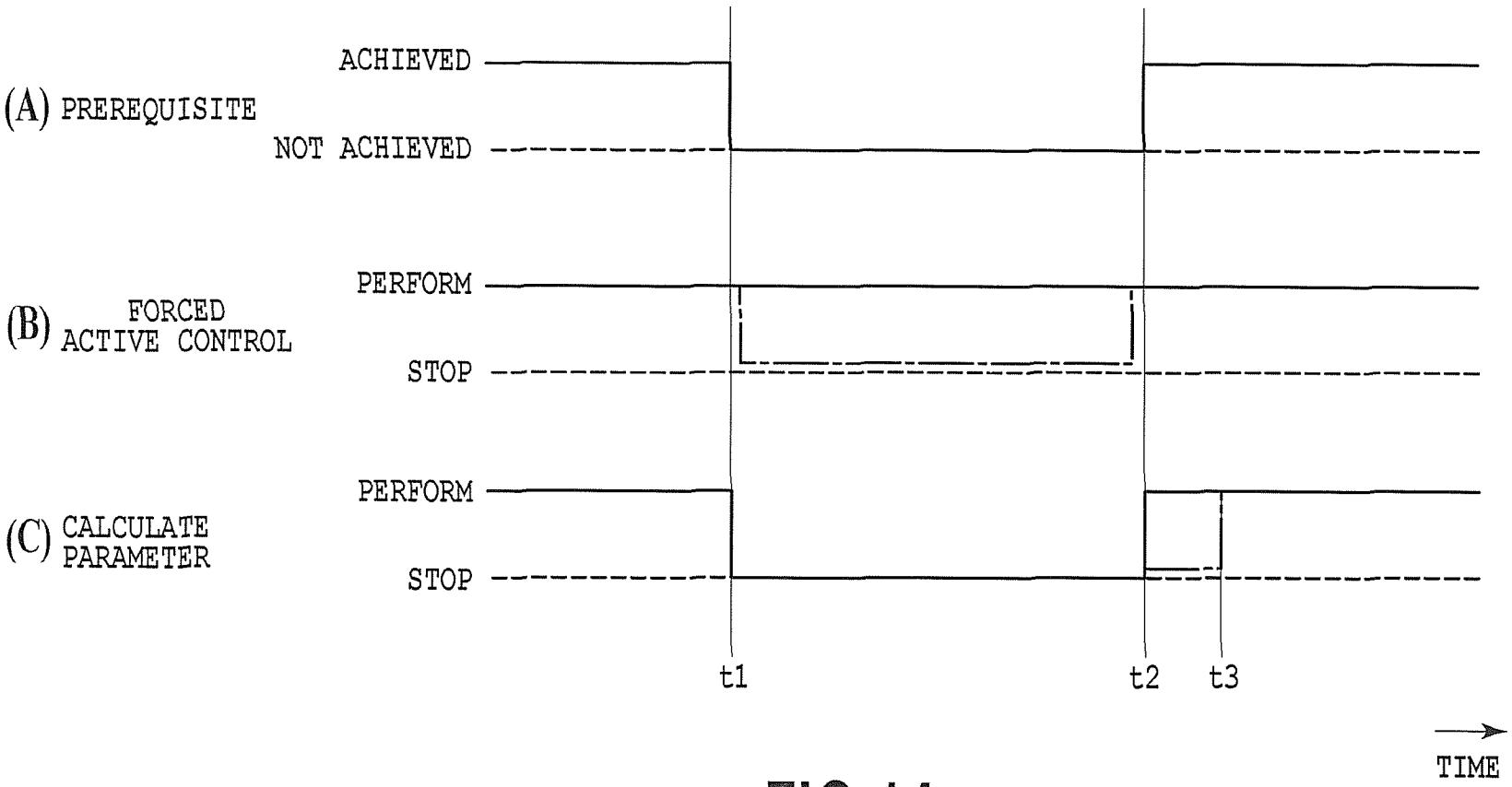
FIG. 14 is a time chart illustrating a first variation.

On the other hand, as shown in FIG. 14, the prerequisite may temporarily fail to be achieved while the forced active control is in execution (t1), the forced active control is stopped or interrupted (this is shown by imaginary lines), and the prerequisite is subsequently re-achieved to resume the forced active control (t2). A possible cause of the non-achievement and re-achievement of the prerequisite is that the number of engine rotations Ne and the load KL temporarily fall out of the respective predetermined ranges and are then brought back into the ranges. While the forced active control is inactive (t1 to t2), the calculation of the output fluctuation parameter $X_2$ is of course stopped, and the acquisition of the data needed for the calculation is also stopped.

When the stopped forced active control is resumed, an amount of time equivalent to, for example, 5 to 10 engine cycles is needed to stabilize the air-fuel ratio feedback control and each sensor output. Thus, during a predetermined time (t2 to t3) immediately after the forced active control is resumed, the calculation of the output fluctuation parameter $X_2$ and the acquisition of the data are stopped (this is shown by imaginary lines).

However, in this case, during the predetermined time (t2 to t3), the calculation of the output fluctuation parameter $X_2$ and the acquisition of the data are stopped even though the prerequisite has been achieved. This may cause missing of opportunities to calculate the output fluctuation parameter $X_2$, to acquire the data, and thus to detect abnormality.

Thus, the present embodiment, when the prerequisite fails to be achieved while the step (D) is in execution, the calculation of the output fluctuation parameter $X_2$ (specifically, data acquisition for the calculation) is stopped, whereas the forced active control is not stopped but is continuously performed (this is shown by solid lines).

Since the forced active control is continuously performed, the air-fuel ratio feedback control and each sensor output have been stabilized to the appropriate states or values immediately after the prerequisite is re-achieved. Hence, according to the present variation, the calculation of the output fluctuation parameter $X_2$, specifically, the data acquisition, is started at a point in time (t2) when the prerequisite is re-achieved (this is shown by solid lines). This enables seizure of more opportunities to calculate the output fluctuation parameter $X_2$, to acquire the data, and thus to detect abnormality.

Moreover, since the forced active control is such control as reduces the air-fuel ratio shift to mitigate the imbalance state, exhaust emission and drivability are rather improved. Thus, even when the forced active control is performed while the prerequisite is not achieved, exhaust emission and drivability are restrained from being affected.

Now, a second variation will be described.

Figure 15:
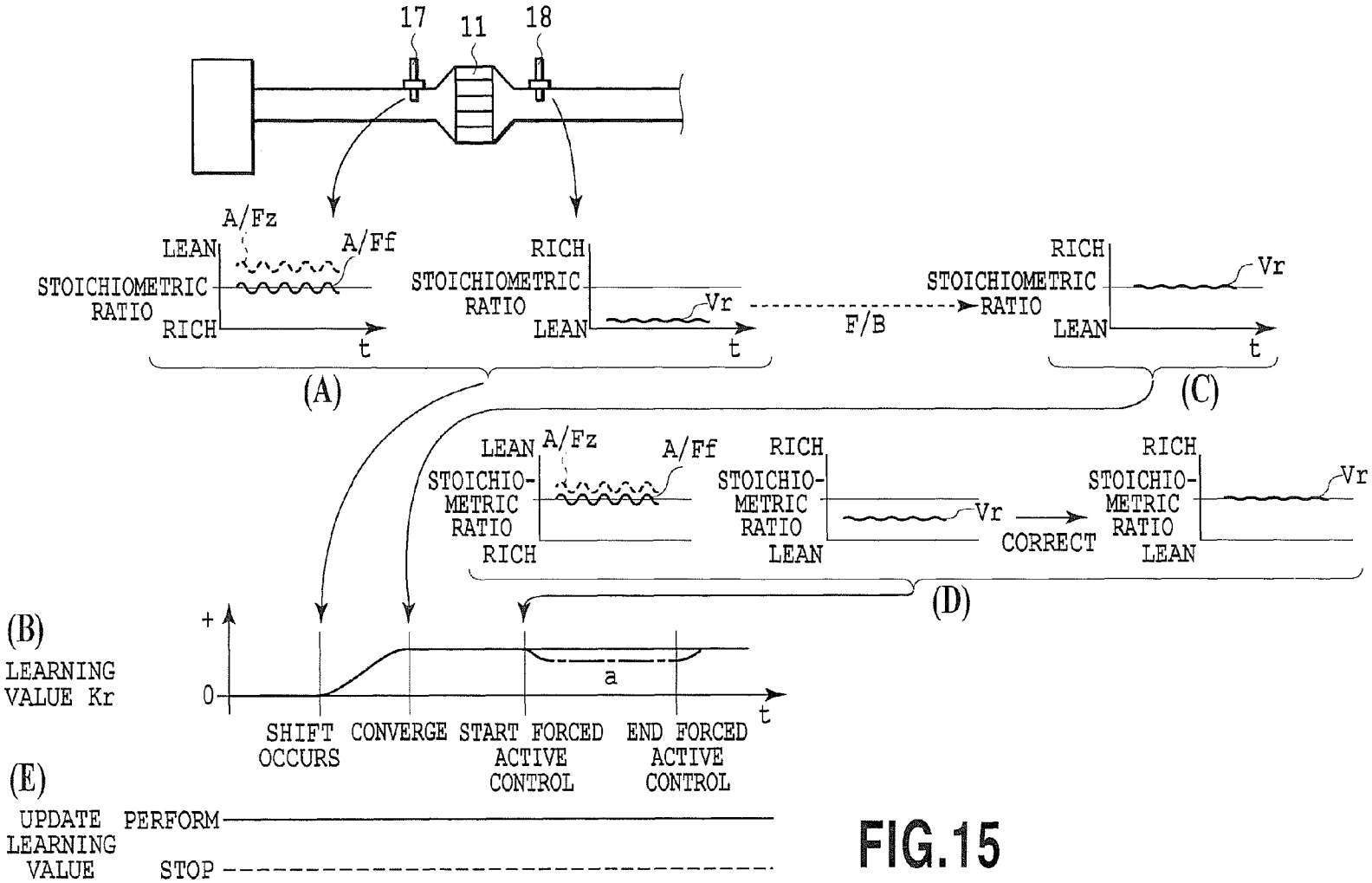
FIG. 15 is a diagram illustrating a second variation.

The above-described basic embodiment calculates the output fluctuation parameters $X_1$ and $X_2$ during the stoichiometric control. Furthermore, as shown in FIG. 15, the stoichiometric control includes the air-fuel ratio main feedback control that may make the output from the pre-catalyst sensor 17 (represented by an air-fuel ratio A/Ff) equal to the stoichiometric ratio and the air-fuel ratio sub feedback control that may make the output from the post-catalyst sensor 18 (represented by an output voltage Vr) equal to the stoichiometric ratio.

As is known (for example, see Japanese Patent Laid-Open No. 2009-30455), when a cylinder is subjected to a rich shift in which the air-fuel ratio shifts relatively significantly toward the rich side, the pre-catalyst sensor output A/Ff deviates from a true air-fuel ratio A/Fz toward the rich side due to the adverse effect of hydrogen generated by the cylinder, as shown in FIG. 15(A). On the other hand, the pre-catalyst sensor output A/Ff is kept in the vicinity of the stoichiometric ratio by the air-fuel ratio main feedback control.

On the other hand, the hydrogen is removed upon passing through the upstream catalyst 11, and thus, the post-catalyst sensor output Vr indicates the true air-fuel ratio A/Fz, that is, an air-fuel ratio leaner than the stoichiometric ratio. This causes the post-catalyst sensor output Vr to deviate toward the lean side with respect to the stoichiometric ratio.

Subsequently, as shown in FIG. 15(B), a learning value Kr for the air-fuel ratio sub feedback control is gradually updated to such a value (positive value) as corrects the amount of injected fuel toward the rich side (increase side) in order to eliminate the lean shift in the pre-catalyst sensor output Vr. The learning value Kr eventually converges. That is, the learning value Kr is changed toward the positive side by a value equivalent to the amount of the lean shift in the post-catalyst sensor output Vr. This eliminates the lean shift as shown in FIG. 15(C).

As shown in FIG. 15(B), if the learning value Kr has converged before the start of the forced active control, execution of the forced active control changes the imbalance rate, causing the learning value Kr to be updated to an inappropriate value that fails to reflect the current situation, as shown by an imaginary line (a). Then, after the end of the forced active control and before the learning value Kr is updated to an appropriate value, the air-fuel ratio sub feedback control is performed with the inappropriate learning value, thus degrading the exhaust emission.

This will be described with reference to a conceptual drawing in FIG. 15(D). When the forced active control is performed so as to reduce a rich shift in one cylinder, the forced active control reduces the amount of a rich shift in the pre-catalyst sensor output A/Ff with respect to the true air-fuel ratio A/Fz which results from the adverse effect of hydrogen. This also reduces the amount of a lean shift in the post-catalyst sensor output Vr with respect to the stoichiometric ratio. The learning value is updated so as to eliminate the reduced lean shift, and thus, decreases as shown by the imaginary line (a) in FIG. 15(B). However, the reduced learning value Kr is no longer appropriate after the forced active control is ended.

Thus, while step (D) is in execution, the learning value Kr is corrected by a value equivalent to the reduction in air-fuel ratio shift carried out by the forced active control, according to the present variation. For example, if the air-fuel shift of the one cylinder is a rich shift, the learning value Kr is corrected toward the decrease side by a value equivalent to the amount of forced active control corresponding to the amount of reduction in rich shift carried out by the forced active control. For example, the learning value Kr is corrected to 0.99 Kr by being reduced by 1(%). The amount of forced active control Bf is preset, and thus, the amount of correction of the learning value Kr may have a preset value.

The correction is carried out from the point in time of the start of the forced active control until the point in time of the end of the forced active control. Furthermore, during the forced active control, the learning value Kr obtained before the start of the forced active control is corrected, and the air-fuel ratio sub feedback control is performed using the corrected learning value Kr.

The present variation can thus avoid a situation in which the learning value Kr is updated to an inappropriate value while the forced active control is in execution and thus a situation in which, after the end of the forced active control, the air-fuel ratio sub feedback control is started or performed with the inappropriate learning value Kr, thus degrading the exhaust emission, as shown by solid lines in FIG. 15(B).

On the other hand, the present variation allows the learning value Kr to be kept appropriate while the forced active control is in execution. As shown in FIG. 15(D), after the correction, the post-catalyst sensor output Vr is substantially prevented from deviating from the stoichiometric ratio, resulting info change in the learning value Kr. Hence, as shown in FIG. 15(E), the update of the learning value Kr is not stopped but is continuously carried out even while the forced active control is in execution.

Figure 16:
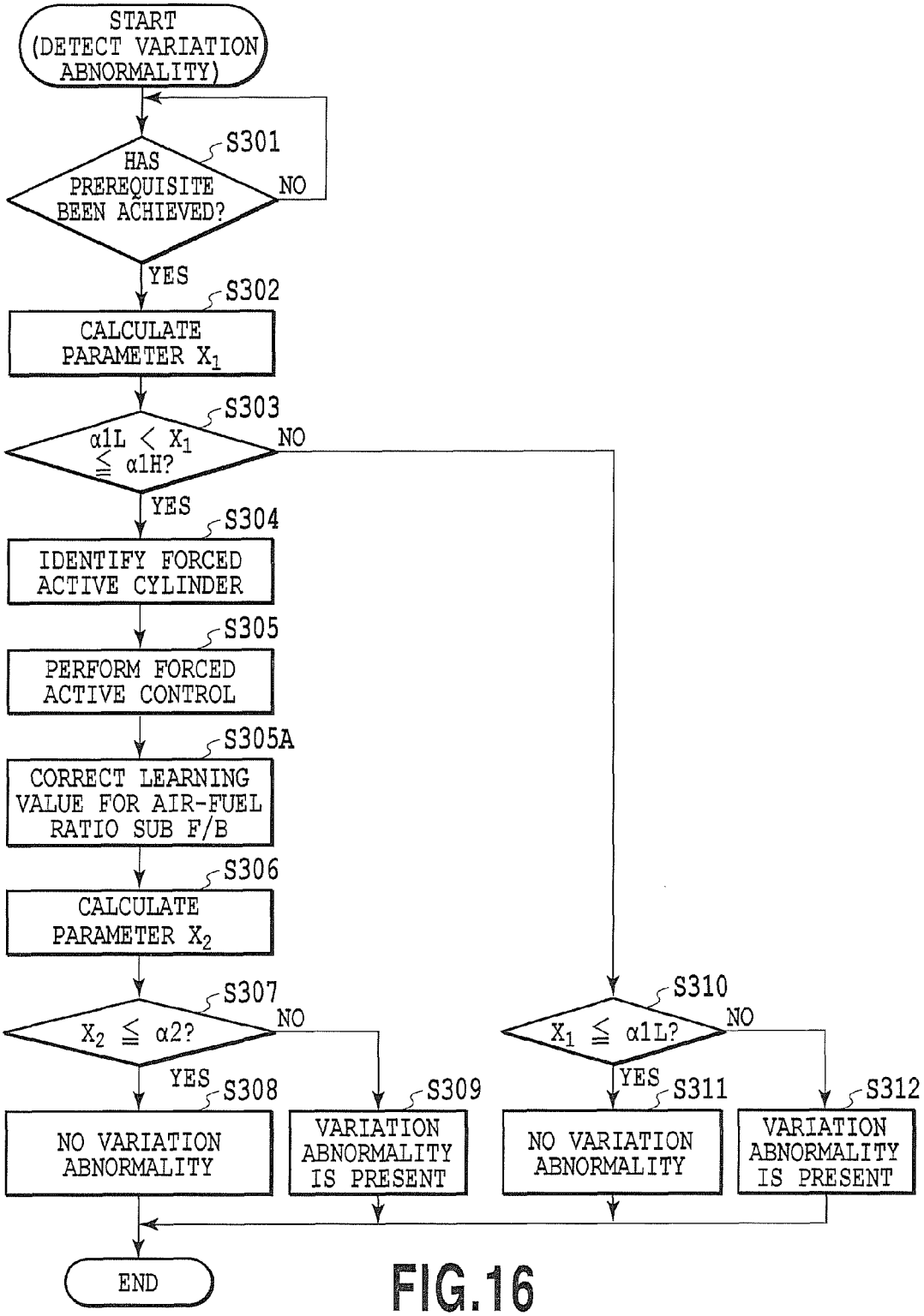
FIG. 16 is a flowchart of a process of detecting variation abnormality according to the second variation.

FIG. 16 shows a flowchart of a process of detecting variation abnormality according to the present variation. This detection process is generally similar to the detection process according to the basic embodiment shown in FIG. 13. The same steps are shown with the numbers thereof changed to the 300s and will thus not be described.

The detection process according to the present variation is different from the detection process according to the basic embodiment only in that step S305A is added between step S305 and step S306.

That is, when the forced active control is performed in step S305, the learning value Kr for the air-fuel ratio sub feedback control is corrected in step S305A. At this time, if a rich shift is occurring in a forced active cylinder subjected to an air-fuel ratio shift, the learning value Kr is corrected to 0.99 Kr. If a lean shift is occurring in the forced active cylinder subjected to the air-fuel ratio shift, the learning value Kr is corrected to 1.01 Kr.

The second variation can be combined with the first variation.

The preferred embodiment of the present invention has been described in detail. However, various other embodiments of the present invention are possible. For example, the above-described numerical values are illustrative and may be variously changed. Furthermore, in some portions of the description, only one of the rich side and the lean side is described. However, those skilled in the art understand that the description of one side is applicable to the description of the other.

The embodiment of the present invention is not limited to the above-described embodiment. The present invention includes any variations, applications, and equivalents embraced in the concepts of the present invention defined by the claims. Thus, the present invention should not be interpreted in a limited manner but is applicable to any other technique belonging to the scope of the concepts of the present invention

What is claimed is:

1. An inter-cylinder air-fuel ratio variation abnormality detection apparatus being configured to calculate a first parameter correlated with a degree of fluctuation of output from a first air-fuel ratio sensor installed in an exhaust passage common to a plurality of cylinders to detect inter-cylinder air-fuel ratio variation abnormality based on the calculated first parameter, the apparatus being configured to carry out:

(A) a step of calculating the first parameter;

(B) a step of determining whether or not the calculated first parameter has a value between a predetermined primary determination upper-limit value and a primary determination lower-limit value;

(C) a step of performing such forced active control as reduces an air-fuel ratio shift in one of the cylinders which is subjected to a most significant air-fuel ratio shift when the calculated first parameter is determined to have a value between the predetermined primary determination upper-limit value and the primary determination lower-limit value;

(D) a step of calculating the first parameter while the forced active control is in execution; and (E) a step of comparing the first parameter calculated while the forced active control is in execution with a predetermined secondary determination value to determine whether or not variation abnormality is present.

2. The inter-cylinder air-fuel ratio variation abnormality detection apparatus according to claim 1, wherein the secondary determination value is pre-specified as a value of the first parameter corresponding to a predetermined upper-limit target value of a second parameter representing a degree of variation in air-fuel ratio among the cylinders, on a first characteristic line representing a relation between the first parameter and the second parameter observed when the first air-fuel ratio sensor is a tolerance lower-limit product and while the forced active control is in execution.

3. The inter-cylinder air-fuel ratio variation abnormality detection apparatus according to claim 2, wherein the primary determination lower-limit value is pre-specified as a value of the first parameter corresponding to the upper-limit target value of the second parameter, on a second characteristic line representing a relation between the first parameter and the second parameter observed when the first air-fuel ratio sensor is a tolerance lower-limit product and while the forced active control is not in execution.

4. The inter-cylinder air-fuel ratio variation abnormality detection apparatus according to claim 2, wherein the primary determination upper-limit value is pre-specified as a value of the first parameter corresponding to a predetermined lower-limit target value of the second parameter, on a third characteristic line representing a relation between the first parameter and the second parameter observed when the first air-fuel ratio sensor is a tolerance upper-limit product and while the forced active control is not in execution.

5. The inter-cylinder air-fuel ratio variation abnormality detection apparatus according to claim 1, which is configured to further carry out (F) a step of comparing the first parameter with at least one of the primary determination upper-limit value and the primary determination lower-limit value to determine whether or not abnormality is present when, in the step (B), the first parameter is determined not to have a value between the primary determination upper-limit value and the primary determination lower-limit value.

6. The inter-cylinder air-fuel ratio variation abnormality detection apparatus according to claim 1, which is configured to stop calculating the first parameter, while continuously performing the forced active control instead of stopping the forced active control when, while the step (D) is in execution, a predetermined prerequisite for execution of the step (D) fails to be achieved.

7. The inter-cylinder air-fuel ratio variation abnormality detection apparatus according to claim 6, which is configured such that, when the prerequisite having not been achieved is re-achieved, the inter-cylinder air-fuel ratio variation abnormality detection apparatus starts calculating the first parameter at a point in time of the re-achievement.

8. The inter-cylinder air-fuel ratio variation abnormality detection apparatus according to claim 1, which is configured to perform, while carrying out the step (D), air-fuel ratio main feedback control based on the output from the first air-fuel ratio sensor and air-fuel ratio sub feedback control based on output from a second air-fuel ratio sensor installed in the exhaust passage downstream of the first air-fuel ratio sensor with a catalyst located between the first and second air-fuel ratio sensors, and to correct a learning value for the air-fuel ratio sub feedback control by a value equivalent to a reduction in air-fuel ratio shift carried out by the forced active control.

* * * * *

UNITED STATES PATENT AND TRADEMARK OFFICE

CERTIFICATE OF CORRECTION

PATENT NO. : 9,328,685 B2
APPLICATION NO. : 14/212400
DATED : May 3, 2016
INVENTOR(S) : Kenji Suzuki et al.

It is certified that error appears in the above-identified patent and that said Letters Patent is hereby corrected as shown below:

In the Specification

In Column 10, Line 01, after "determination value", delete "a" and insert --α--, therefor.

In Column 17, Line 03, before "engine cycles equal" insert --$M_+$--.

In Column 21, Line 17, delete "info" and insert --in no--, therefor.

Signed and Sealed this
Nineteenth Day of July, 2016

Michelle K. Lee

Michelle K. Lee
*Director of the United States Patent and Trademark Office*